US011918060B2

(12) United States Patent
Matsui

(10) Patent No.: US 11,918,060 B2
(45) Date of Patent: Mar. 5, 2024

(54) BLOWER FOR AIR-CONDITIONED GARMENT AND AIR-CONDITIONED GARMENT

(71) Applicant: Kabushiki Kaisha ACB, Kadoma (JP)

(72) Inventor: Masakazu Matsui, Kadoma (JP)

(73) Assignee: KABUSHIKI KAISHA ACB, Osaka (JP)

( * ) Notice: Subject to any disclaimer, the term of this patent is extended or adjusted under 35 U.S.C. 154(b) by 310 days.

(21) Appl. No.: 17/279,678

(22) PCT Filed: Sep. 23, 2019

(86) PCT No.: PCT/JP2019/037154
§ 371 (c)(1),
(2) Date: Mar. 25, 2021

(87) PCT Pub. No.: WO2020/080042
PCT Pub. Date: Apr. 23, 2020

(65) Prior Publication Data

US 2021/0392962 A1 Dec. 23, 2021

(30) Foreign Application Priority Data

Oct. 17, 2018 (JP) ..... 2018-196155
Apr. 4, 2019 (JP) ..... 2019-071854

(51) Int. Cl.
*F04D 25/08* (2006.01)
*A41D 13/002* (2006.01)
(Continued)

(52) U.S. Cl.
CPC ..... *A41D 13/0025* (2013.01); *F04D 25/0673* (2013.01); *F04D 25/084* (2013.01); *F04D 29/601* (2013.01)

(58) Field of Classification Search
CPC ..... A41D 13/0025; F04D 25/0673; F04D 25/084; F04D 25/12
See application file for complete search history.

(56) References Cited

U.S. PATENT DOCUMENTS 11,051,563 B2 * 7/2021 Kittaka ..... F04D 29/601
2007/0050878 A1 * 3/2007 Ichigaya ..... A41D 13/0025 2/69

(Continued)

FOREIGN PATENT DOCUMENTS

JP 2006307817 A * 11/2006
WO WO-2005000054 A1 * 1/2005 ..... A41D 13/0025
WO 2005/082182 A1 9/2005

OTHER PUBLICATIONS

Machine translation of WO 2005000054, Ichigaya, published Jan. 6, 2005 (Year: 2005).*

*Primary Examiner* — David E Sosnowski
*Assistant Examiner* — Jason G Davis
(74) *Attorney, Agent, or Firm* — POSZ LAW GROUP, PLC

(57) ABSTRACT

A blower for an air-conditioned garment is provided with a blower unit having a fan driven by a motor, and a power supply unit for supplying power to the blower unit. The blower unit is provided with a first housing that houses the fan. The power supply unit is provided with a second housing that houses a battery. The first housing is provided with a first contact part through which the power supplied by the power supply unit can be supplied. The second housing is provided with a second contact part which is arranged in a position corresponding to the first contact part and abuts the first contact part. The first housing and the second housing each have a shape detachably engageable with each other.

8 Claims, 23 Drawing Sheets

(51) Int. Cl.
*F04D 25/06* (2006.01)
*F04D 29/60* (2006.01)

(56) References Cited

U.S. PATENT DOCUMENTS

2015/0272251 A1* 10/2015 Welsh ..... A42B 1/008
165/121
2018/0209432 A1* 7/2018 Lee ..... F04D 25/08

* cited by examiner

Blower for air-conditioned garment 1

Blower for air-conditioned garment 1

(a)

(b)

(a)

(b)

Blower for air-conditioned garment 200

(a)

(b)

(a)

(b)

(a)

(b)

(a)

(b)

(a)

(b)

BLOWER FOR AIR-CONDITIONED GARMENT AND AIR-CONDITIONED GARMENT

CROSS REFERENCE TO RELATED APPLICATIONS

This application is a U.S. national stage application of International Patent Application No. PCT/JP2019/037154 filed on Sep. 23, 2019 which claims priority to Japanese Patent Application No. 2018-196155 filed on Oct. 17, 2018 and Japanese Patent Application No. 2019-071854 filed on Apr. 4, 2019 the disclosures of which are incorporated herein by reference.

TECHNICAL FIELD

The present application relates to a blower for an air-conditioned garment and an air-conditioned garment, and particularly to a power supply technology.

BACKGROUND

Hitherto, as power supplying means for supplying power to a fan that is blowing means, a blower in which a housing that stores a secondary battery therein and the fan are connected to each other by a cable has been provided (for example, Patent Literature 1). When this related-art blower is installed on an air-conditioned garment, the fan that is the blowing means is mounted on a mounting hole formed in the air-conditioned garment, and the housing that stores the secondary battery therein is accommodated in a pocket and the like of the air-conditioned garment. The power to the fan is supplied from the secondary battery via the cable.

PATENT LITERATURE

Patent Literature 1: International Publication No. WO 2005/082182

According to the blower disclosed in Patent Literature 1 above, there is an advantage in that a wearer of the air-conditioned garment can freely move in a state in which the blower is operating. However, there has been a problem in that cables or cable terminals disposed in the air-conditioned garment are easily damaged because the air-conditioned garment deforms by the movement of the wearer.

SUMMARY

Thus, in order to solve the above-mentioned related-art problem, an object is to provide a blower for an air-conditioned garment and an air-conditioned garment that enable stable supplying of power to the blower through suppression of damage to cables or cable terminals.

In order to achieve the above-mentioned object, a blower is provided that includes: a blower unit having a fan driven by a motor; and a power supply unit that supplies power to the blower unit. In the blower for the air-conditioned garment, the blower unit includes a first housing that houses the fan, the power supply unit includes a second housing that houses a battery, the first housing includes: a first contact part through which the power supplied by the power supply unit is able to be supplied; and a first flange that extends outside of an end part, the second housing includes: a through hole in which the first housing is insertable in a rotation shaft direction of the fan; a plurality of holding parts that each house the battery; a second contact part that is arranged in a position corresponding to the first contact part and abuts the first contact part; and a first receiving part that abuts the first flange when being engaged with the first housing, the first housing and the second housing each have a shape detachably engageable with each other, and sandwich a peripheral edge of a mounting hole formed in the air-conditioned garment between the first flange and the first receiving part when the first housing and the second housing are engaged with each other, and the plurality of holding parts are arranged in predetermined regions that are unevenly distributed on a periphery of the through hole.

In the blower for the air-conditioned garment, the first housing further includes an accommodation part capable of accommodating a medical agent, and the accommodation part is disposed on a front side of the fan in a flow direction of gas.

In another embodiment, a blower includes: a blower unit having a fan driven by a motor; and a power supply unit that supplies power to the blower unit. In the blower for the air-conditioned garment, the blower unit includes a first housing that houses the fan, the power supply unit includes a second housing including: a holding part that houses a battery; and a through hole in which the first housing is insertable in a rotation shaft direction of the fan, the first housing includes a first contact part through which the power supplied by the power supply unit is able to be supplied, the second housing includes: a second contact part that is arranged in a position corresponding to the first contact part and abuts the first contact part; and an accommodation part capable of accommodating a medical agent, the first housing and the second housing each have a shape detachably engageable with each other, and the accommodation part is disposed on an outer side with respect to an outer diameter of the fan in the rotation shaft direction and has a ventilation part on a side facing the fan.

More specifically, an air-conditioned garment is provided on which the blower for the air-conditioned garment is mounted.

The air-conditioned garment may further include a ventilation adjustment part that is formed on a base end side of a sleeve part and able to adjust a ventilation quantity on an inner side of the sleeve part.

In another embodiment, a blower includes: a main body part including: a motor that drives a fan; and a power supply unit; and a rear cover that is engaged with the main body part, the blower being installable on the air-conditioned garment by separable engagement of the main body part and the rear cover. In the blower for the air-conditioned garment, the main body part includes: a third contact part that is connected to the power supply unit and through which power can be supplied; and a fourth contact part that is connected to the motor and through which power can be supplied, the rear cover includes an electrically-conductive part that abuts the third contact part and the fourth contact part, and the electrically-conductive part relays power supplied to the motor from the power supply unit by abutting the third contact part and abutting the fourth contact part when the main body part and the rear cover are engaged with each other.

In the blower for the air-conditioned garment, the main body part further includes a first locking part that is engaged with the rear cover, the rear cover further includes a second locking part that is engaged with the first locking part of the main body part, the third contact part and the fourth contact part are disposed in the first locking part so as to be separated from each other, and the electrically-conductive part is disposed in a position in the second locking part corresponding to the third contact part, and the fourth contact part.

In another embodiment, a blower includes: a main body part including: a fan; and a motor that drives the fan; and a rear frame that is engaged with the main body part, the blower being installable on the air-conditioned garment by separable engagement of the main body part and the rear frame. In the blower for the air-conditioned garment, the main body part includes: a power supply unit that supplies power to the motor; a control unit that controls driving of the motor; and an operation input unit that inputs a signal to the control unit in accordance with operation of a user, the power supply unit includes a plurality of power supply units, each power supply unit being formed such that a distance between the power supply unit and a rotation shaft of the fan in a direction orthogonally intersecting the rotation shaft of the fan is longer than an outer diameter of the fan, each power supply unit being close to an outer periphery of the fan at a longitudinal side, the power supply units being unevenly distributed on a lower side near the outer periphery of the fan, and the main body part and the rear frame are formed so as to sandwich the air-conditioned garment between the main body part and the rear frame.

In the blower for the air-conditioned garment, the rear frame includes a suction port that sucks in gas, and the suction port has an inner diameter that gradually expands toward a rear side in a flow direction of the gas.

In the blower for the air-conditioned garment, the main body part further includes: a through hole that houses the fan in a rotation shaft direction of the fan; and a fan cover that detachably occludes the through hole on a front side with respect to the fan in a flow direction of gas.

In the blower for the air-conditioned garment, the fan cover includes an engaging part that is engaged with an inner peripheral side surface of the through hole, and a length from the rotation shaft to an inner peripheral wall of the engaging part is longer than the outer diameter of the fan when the fan cover is engaged with the inner peripheral side surface.

In the blower for the air-conditioned garment, the fan cover further includes an exhaust, port formed on the front side in the flow direction of the gas so as to be continuous with the engaging part, and the exhaust port has an inner periphery that expands to an outer side from the inner peripheral wall of the engaging part.

In another embodiment, a blower for an air-conditioned garment includes: an axial fan that causes gas to flow in a rotation shaft direction; and a motor that drives the axial fan; and a rear frame that is engaged with the main body part, the blower being installable on the air-conditioned garment by separable engagement of the main body part and the rear frame. In the blower for the air-conditioned garment, the main body part includes: a power supply unit that supplies power to the motor; a control unit that controls driving of the motor; and an operation input unit that inputs a signal to the control unit in accordance with operation of a user, the power supply unit includes a plurality of power supply units, each power supply unit being formed such that a distance between the power supply unit and a rotation shaft of the axial fan in a direction orthogonally intersecting the rotation shaft of the axial fan is longer than an outer diameter of the axial fan, the power supply units being disposed so as to surround the axial fan in an unevenly distributed manner on a lower side of the axial fan, and the main body part and the rear frame are formed so as to sandwich the air-conditioned garment between the main body part and the rear frame.

Accordingly, the power can be stably supplied to the blower by engaging the blower unit and the power supply unit with each other.

DETAILED DESCRIPTION

Figure 1:
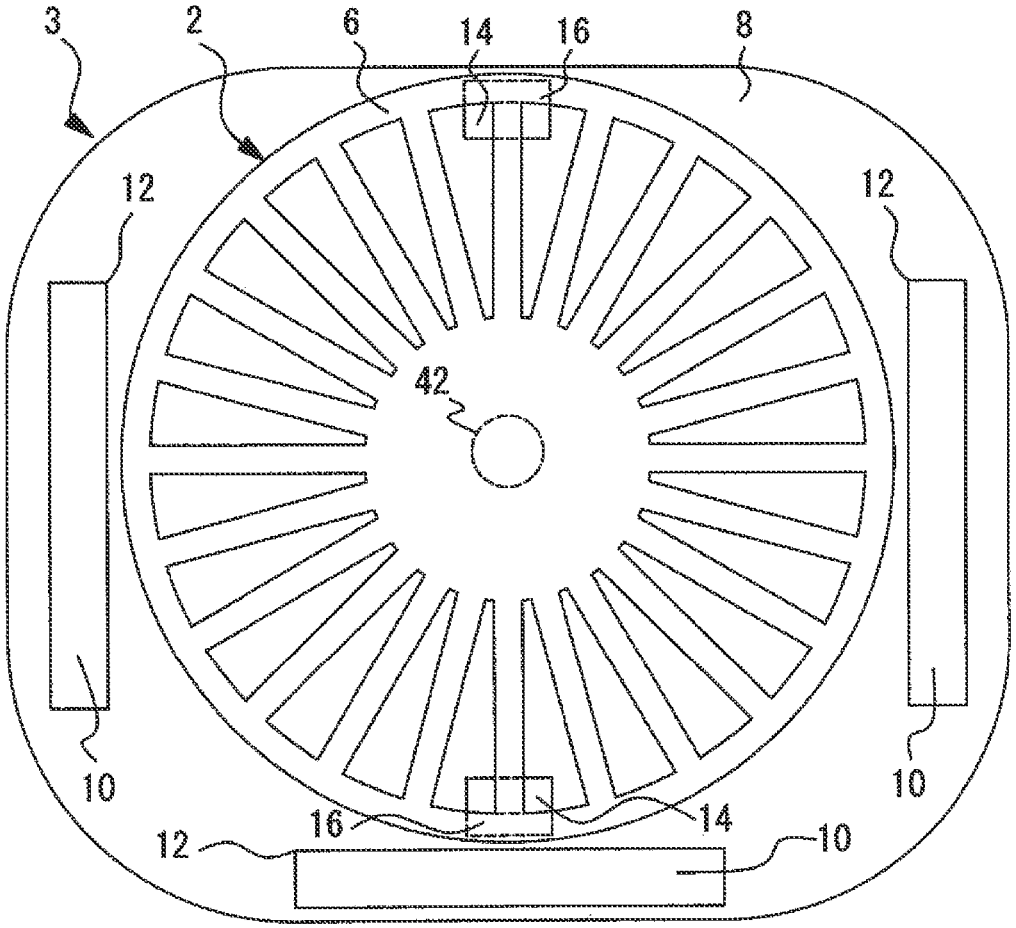
FIG. 1 is a front view of a blower for an air-conditioned garment in a first embodiment.

Preferable embodiments of the present invention are described in detail below with reference to the drawings. In the drawings referred to below, members common throughout the drawings are denoted by the same reference characters and overlapping descriptions regarding those members are omitted.

First Embodiment

FIG. 1 is a front view illustrating a blower 1 for an air-conditioned garment in a first embodiment of the present invention. The blower 1 for the air-conditioned garment is used by being installed on an air-conditioned garment 100. The blower 1 for the air-conditioned garment is installed on the air-conditioned garment 100 by being inserted in a mounting hole formed in the air-conditioned garment 100. The blower 1 for the air-conditioned garment includes an axial blower and a centrifugal blower. The blower 1 for the air-conditioned garment includes a blower unit 2 having a fan driven by a motor, and a power supply unit 3 that, supplies power to the blower unit 2.

The blower unit 2 includes the fan, the motor that drives the fan, and a first housing 6 that houses the fan and the motor. The first, housing 6 is made of resin to have a circular shape in a front view and houses the motor and the fan. The first housing 6 includes first contact parts 14 through which the power supplied by the power supply unit 3 can be supplied. The fan is joined to a rotation shaft 42.

The first contact parts 14 are made of metal plates through which power can be supplied. The first contact parts 14 can be disposed in desired positions in the first housing 6 and are preferably disposed in positions close to a second housing 8 included in the power supply unit 3. The first contact parts 14 may be integrally formed with the first housing 6 or may be separable from the first housing 6.

The power supply unit 3 includes the second housing 9 that can house batteries. The second housing 8 has a substantially rectangular shape in a front view. The second housing 8 has a through hole that passes through the second housing 8 from the front surface side to the rear surface side. The through hole has a shape in which the first housing 6 can be inserted and preferably has a shape that can be engaged with the first housing 6 when the first housing 6 is inserted in the through hole.

The second housing 8 includes a plurality of holding parts 12 that each house a battery 10. The batteries 10 are composed of storage batteries, for example. The second housing 8 includes second contact parts 16 for supplying power from the batteries 10 to the motor housed in the first housing 6. The second contact parts 16 are made of metal plates and the like through which power can be supplied. The second contact parts 16 are disposed in positions corresponding to the first contact parts 14. The second contact parts 16 abut the first, contact parts 14 when the first housing 6 and the second housing 8 are engaged with each other. In the illustrated example, the second contact parts 16 are disposed in positions corresponding to the first contact parts 14 on a peripheral edge of the through hole formed in the second housing 8. The second contact parts 16 may be integrally formed with the second housing 8 or may be separable from the second housing 8.

Figure 2:
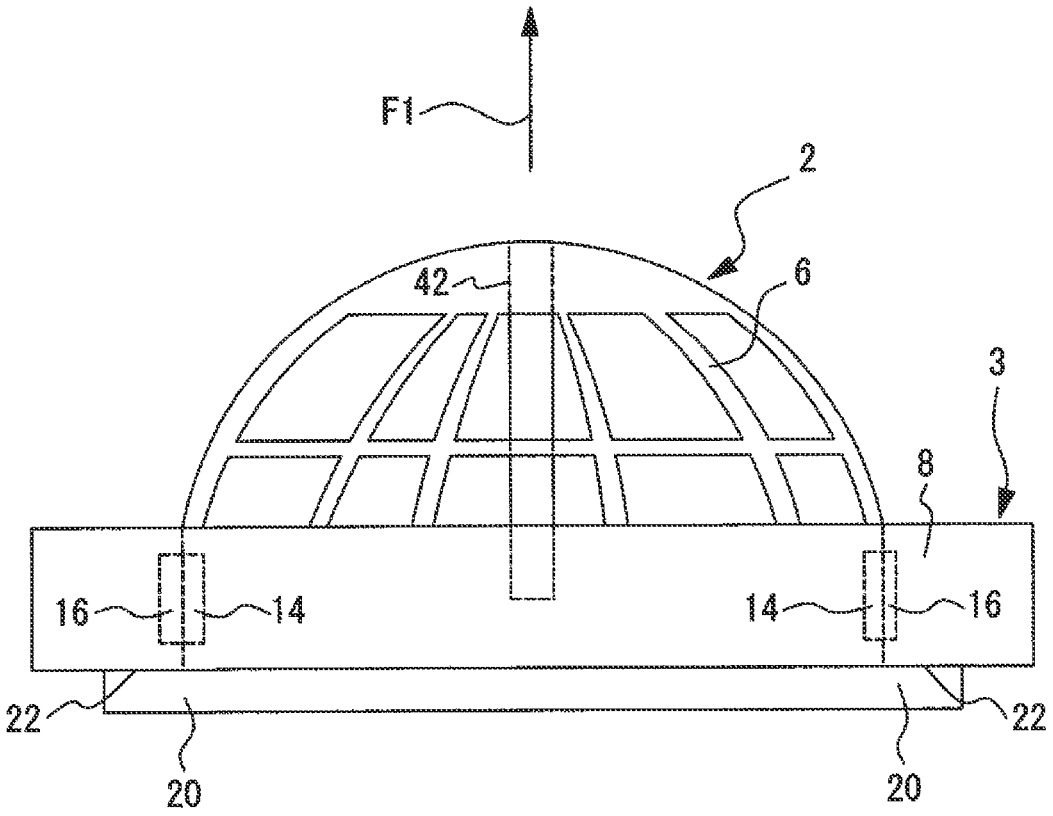
FIG. 2 is a side view of the blower for the air-conditioned garment in the first embodiment.

FIG. 2 is a side view of the blower 1 for the air-conditioned garment in the first embodiment. The blower unit 2 is detachably engaged with the power supply unit 3. The blower unit 2 is engaged with the power supply unit 3 when the first housing 6 is inserted in the through hole formed in the second housing 8 of the power supply unit 3.

The first housing 6 includes a flange 20. The flange 20 is formed on the rear side of the first housing 6 when seen from an airflow direction F1 when the fan is rotated. The flange 20 is formed so as to extend outside of an outer edge of the first housing 6 on the rear side thereof.

When the first housing 6 is inserted in the through hole formed in the second housing 3 from the airflow direction F1, the flange 20 abuts the peripheral edge of the through hole in the second housing 8. In other words, the first housing 6 and the second housing 8 are engaged with each other by the abutment of the flange 20 and the peripheral edge of the through hole in the second housing 8.

When the first housing 6 and the second housing 6 are engaged with each other, the second housing 8 is arranged on the outer side with respect to the outer diameter of the fan about the rotation shaft 42 in the first housing 6. When the fan rotates about the rotation shaft 42, air flows in the airflow direction F1. By arranging the second housing 8 on the outer side with respect to the outer diameter of the fan, the second housing 8 can be prevented from obstructing the flow of air.

When the first housing 6 and the second housing 8 are engaged with each other, the first contact parts 14 and the second contact parts 16 abut each other. As a result, power is supplied to the blower unit 2 from the power supply unit 3, and the motor of the blower unit 2 is driven. Although not shown, the first contact parts 14 may be biased in a direction abutting the second contact, parts 16 by springs and the like. Alternatively, the second contact parts 16 may be biased in a direction abutting the first contact parts 14 by springs and the like instead. As a result, the first contact parts 14 and the second contact parts 16 abut each other in a more reliable manner, and power can be satisfactorily supplied therethrough.

When the fan rotates by the driving of the motor, air is sucked in from the outer side of the air-conditioned garment. 100 and is discharged into the air-conditioned garment 100 toward the airflow direction F1. The air discharged into the air-conditioned garment 100 is discharged to the outside from openings in sleeve parts and a neck part. In other words, the air in the air-conditioned garment 300 flows without stagnation, and hence removes heat from the skin surface of the wearer. As a result, an abnormal rise in the body temperature of the wearer can be prevented and heatstroke and the like car, be avoided.

Figure 3:
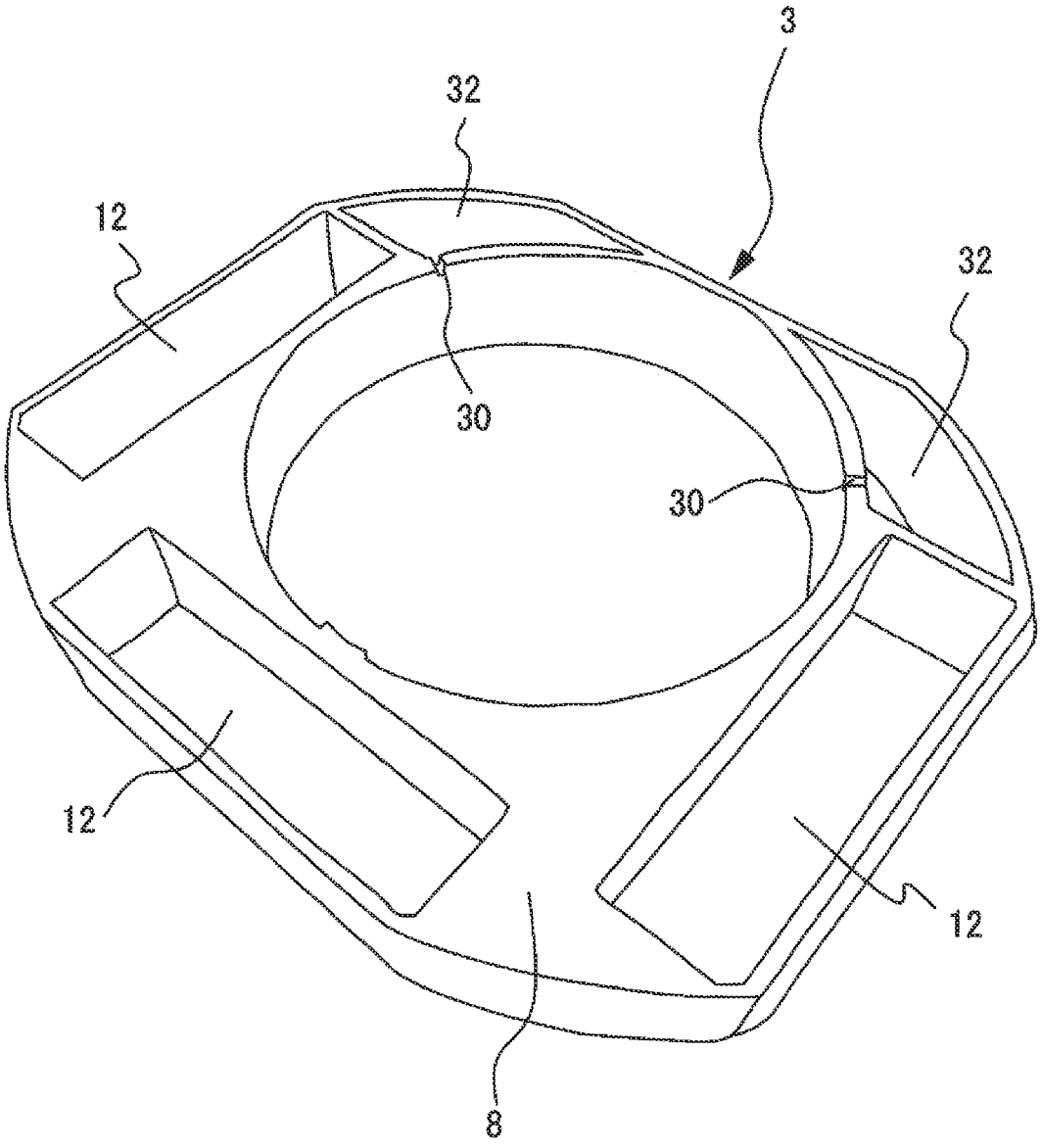
FIG. 3 is a perspective view of a power supply unit in the first embodiment.

FIG. 3 is a perspective view illustrating one example of the power supply unit 3 in the first embodiment. The second housing 8 has a through hole that passes through the second housing 8 in the thickness direction. The through hole has a shape that is substantially the same as that of the cross section of the first housing 6 in a front view, and the first housing 6 can be inserted therein.

The second housing 8 includes accommodation parts 32 that can each accommodate a medical agent. The accommodation parts 32 are provided on the peripheral edge of the through hole and are spaced apart from the through hole by a wall surface. The accommodation parts 32 each include a ventilation part 30 in the wall surface on the through hole side. The ventilation part 30 may be composed of a hole that passes through the wall surface or may be composed of breathable fiber. In the example illustrated in FIG. 3, the ventilation parts 30 are notches formed in the wall surface that, spaces the accommodation parts 32 and the through hole apart from each other.

The accommodation parts 32 can house objects containing fiber such as cloth and cotton moistened with medical agents such as deodorant and insect repellent. Air flows in the accommodation parts 32 from the fan side or flows out from the accommodation parts 32 to the fan side via the ventilation parts 30. The configurations, the functions, and the like of the ventilation parts 30 are described below.

Figure 4:
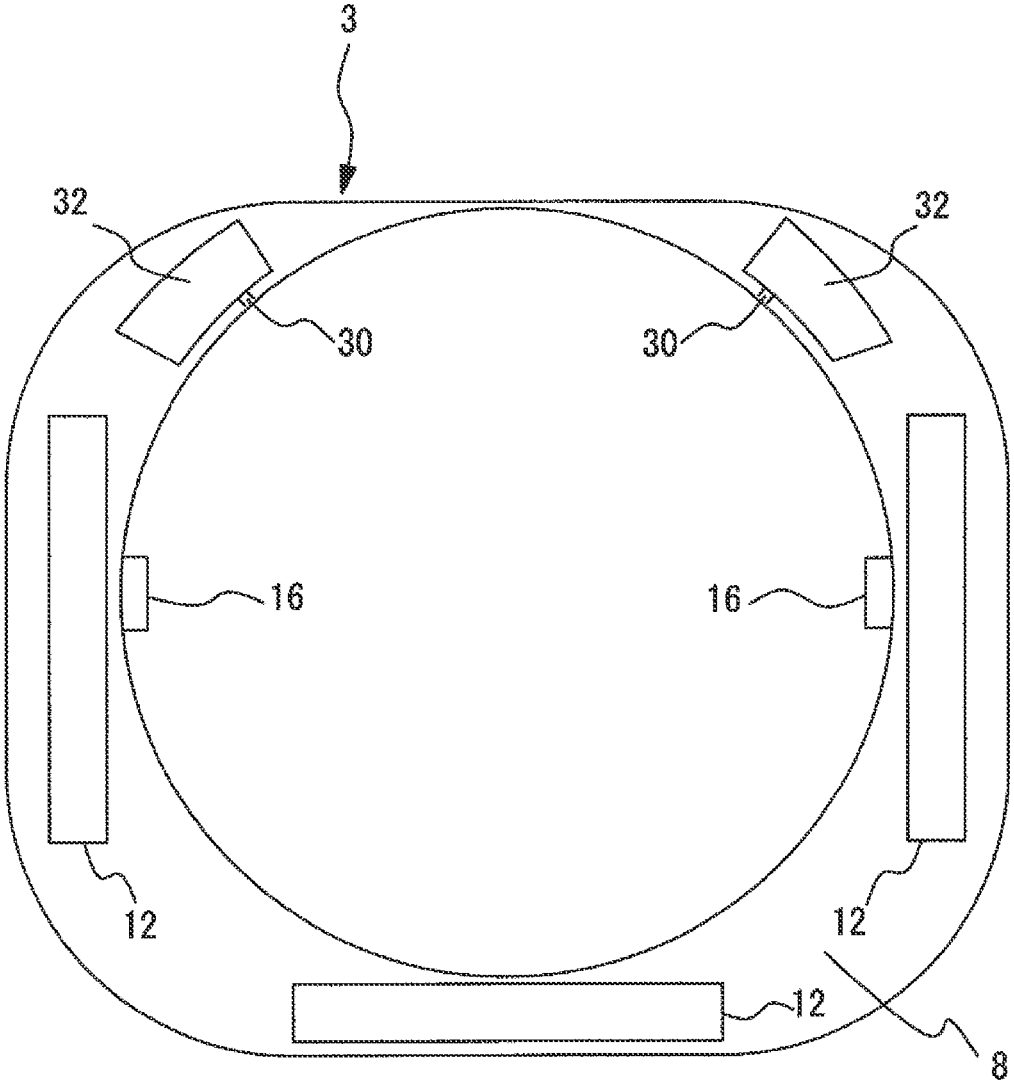
FIG. 4 is a front view of the power supply unit in the first embodiment.

FIG. 4 is a front view illustrating one example of the power supply unit 3 in the first embodiment. As described above, the second housing 8 has a through hole in the thickness direction at a place near the center. The second housing 3 includes the holding parts 12 that accommodate the batteries 10 on the peripheral edge of the through hole. The holding parts 12 are frames that each have a shape corresponding to the shape of the battery 10 and are integrally formed with the second housing 8.

The holding parts 12 are disposed in the peripheral edge of the through hole by a plurality of numbers. The holding parts 12 are arranged such that the longitudinal direction thereof is close to the peripheral edge of the through hole. The holding parts 12 are arranged so as to be unevenly distributed on the peripheral edge of the through hole. As a result, when the blower 1 for the air-conditioned garment is mounted on the air-conditioned garment 100, the blower 1 for the air-conditioned garment becomes stable in a state in which the holding parts 12 are positioned on the lower side by the weight of the batteries 10 housed in the holding parts 12.

In other words, by the weight of the batteries 10 housed in the plurality of holding parts 12, the center of gravity of the blower 1 for the air-conditioned garment becomes lower than the rotation shaft of the fan. Therefore, a case where the blower 1 for the air-conditioned garment itself rotates in accordance with the rotation of the fan can be satisfactorily suppressed.

In the examples illustrated in FIG. 3 and FIG. 4, a case where the second housing 9 includes the plurality of holding parts 12 has been shown, but the second housing 8 may include one holding part 12 that can house the plurality of batteries 10 instead. As a result, worker hours for forming the second housing 8 can be reduced.

The second housing 8 includes the second contact parts 16 on an inner peripheral wall of the through hole. The second contact parts 16 are disposed in positions corresponding to the first contact parts 14 formed on the first housing 6. The second contact parts 16 may be biased in a through-hole central-axis direction by springs and the like.

The second housing 8 includes the accommodation parts 32 that can each accommodate a medical agent on the peripheral edge of the through hole. As described above, the accommodation parts 32 are included on the peripheral edge of the through hole. The accommodation parts 32 are arranged so as to be positioned near the outer edge of the fan when the blower unit 2 and the power supply unit 3 are engaged with each other. The accommodation parts 32 each include the ventilation part 30 in the wall surface that spaces the accommodation part 32 and the through hole apart from each other. The ventilation part 30 may be a notch or may be a hole provided so as to pass through the wall surface that spaces the through hole apart.

Figure 5:
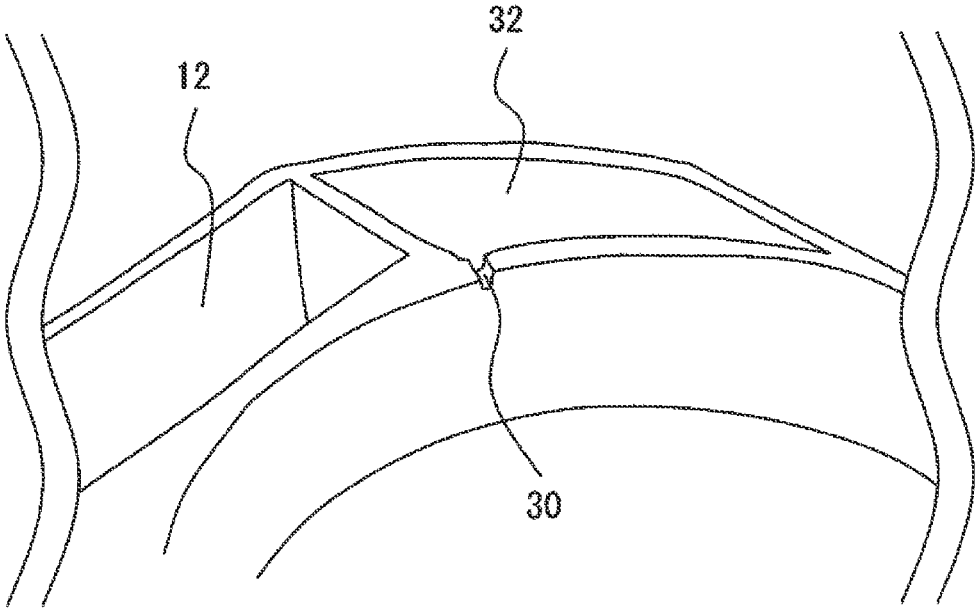
FIG. 5 is an enlarged view of the power supply unit in the first embodiment.
Figure 5:
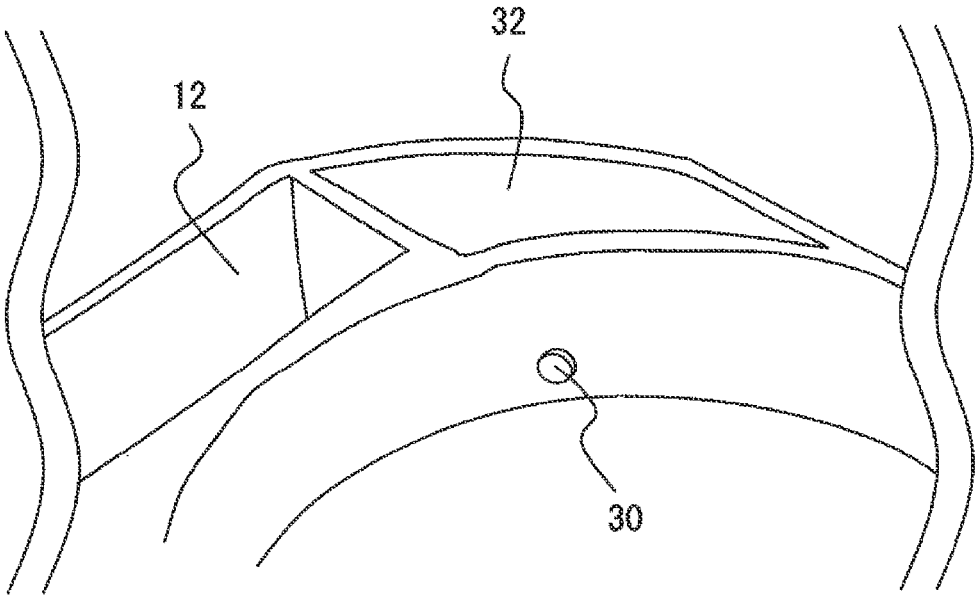

FIG. 5 illustrates a place on the periphery of the ventilation part 30 in the first embodiment in an enlarged manner. In the example in FIG. 5(*a*), the ventilation part 30 is a notch formed in an upper edge of the wall surface that spaces the accommodation part 32 and the through hole apart from each other. When air is pushed out in the airflow direction F1 (see FIG. 2) by the rotation of the fan, the atmospheric pressure on the fan side becomes higher than the atmospheric pressure in the accommodation part 32.

Therefore, the air flows into the accommodation part 32 from the fan side via the ventilation part 30. The accommodation part 32 has a hole in a wall surface, which is on the rear side with respect to the airflow direction F1 and does not face the fan (not shown). When the air flowing in from the fan side flows out from this hole, particles generated when the medical agent arranged in the accommodation part 32 is vaporized are discharged with the air.

The particles discharged with the air are discharged to the outside of the air-conditioned garment 100 via grooves formed in the power supply unit 3 and the blower unit 2. For example, by arranging fiber and the like moistened with insect repellent in the accommodation part 32, particles generated by the vaporization of the insect repellent when the fan rotates is discharged to the outside of the air-conditioned garment 100. As a result, the particles float around the air-conditioned garment 100, and hence insects can be kept away from places around the wearer.

It is mote preferred that the ventilation part 30 be gradually inclined to the front side with respect, to the airflow direction F1 from the fan side to the accommodation parts 32 side. This is because the air pushed out toward the airflow direction F1 flows into the ventilation part 30 from the fan side in a further easier manner.

In the example illustrated in FIG. 5(*b*), the ventilation part 30 is a hole provided so as to pass through the wall surface that spaces the accommodation part 32 and the through hole apart from each other. In the illustrated example, the ventilation part 30 is formed on the rear side with respect to the airflow direction F1 (see FIG. 2). By the rotation of the fan, the atmospheric pressure of the air on the fan side becomes higher than that of the air in the accommodation part 32.

In this case, the air on the fan side of which atmospheric pressure is high flows into the accommodation part 32 via the ventilation part 30. Accordingly, the air in the accommodation part 32 of which atmospheric pressure is low is pushed out to the far side from the ventilation part 30. As a result, particles generated by the vaporization of the medical agent in the accommodation part 32 are discharged to the fan side via the ventilation part 30. Then, those particles are diffused toward the airflow direction F1 caused by the rotation of the fan.

For example, when fiber moistened with deodorant and the like is arranged in the accommodation part 32, particles of the deodorant and the like that have vaporized are discharged to the fan side via the ventilation part 30 and are diffused into the air-conditioned garment toward the airflow direction F1.

In this case, it is more preferred that the hole forming the ventilation part 30 be gradually inclined to the front side with respect to the airflow direction F1 from the accommodation part 32 to the fan side. As a result, the air in the accommodation part 32 of which atmospheric pressure is low is easily discharged to the fan side through the ventilation part 30, and hence the particles of the medical agent are efficiently discharged to the fan side.

Figure 6:
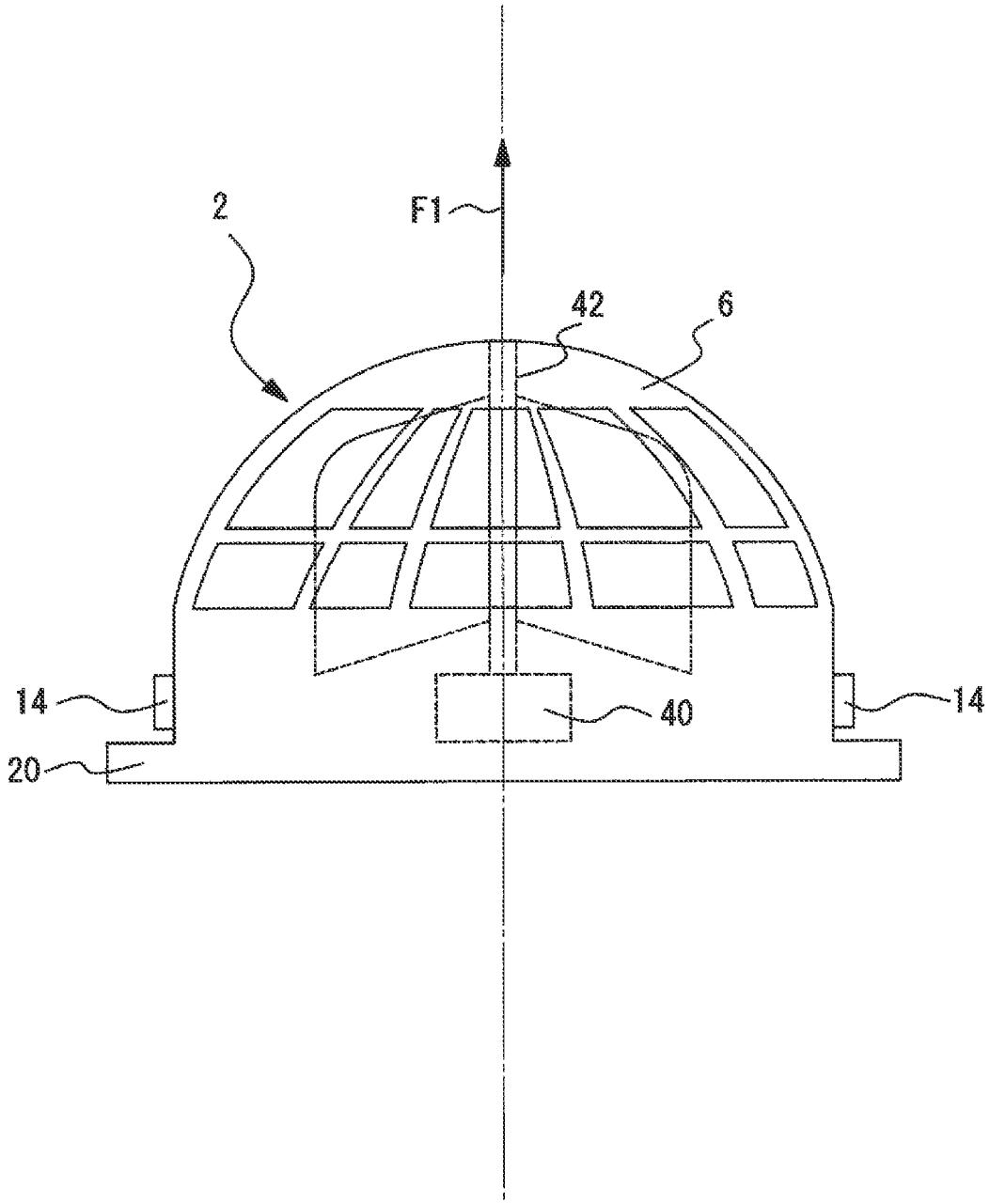
FIG. 6 is a side view of a blower unit in the first embodiment.

FIG. 6 is a side view illustrating one example of the blower unit 2 in the first embodiment. The blower unit 2 includes the first housing 6 that houses the fan and the motor. The first housing 6 includes the first contact parts 14 through which the power supplied by the power supply unit 3 can be supplied, and the flange 20 (first flange) formed on the rear surface side.

The first housing 6 houses the fan, a motor storage part 40 that stores the motor therein, and the rotation shaft 42 provided in a standing manner from the motor storage part 40 toward the airflow direction F1. An AC motor may be used for the motor, or the motor may be a DC motor. The first housing 6 has a dome shape in a side view and forms a steeple toward the airflow direction F1 generated by the rotation of the fan.

The first contact parts 14 are formed on a side wall of the first housing 6 in a protruding manner. The first contact parts 14 are disposed in positions corresponding to the second contact parts 16 in the second housing 8. The first contact parts 14 may be biased toward the outer side by springs and the like.

The flange 20 (first flange) extends from an end part of the first housing 6 on the rear side with respect to the airflow direction F1 to the outer side in a continuous manner. The flange 20 may be integrally formed with the first housing 6 or may be bonded to the first housing 6 in a separable manner.

Figure 7:
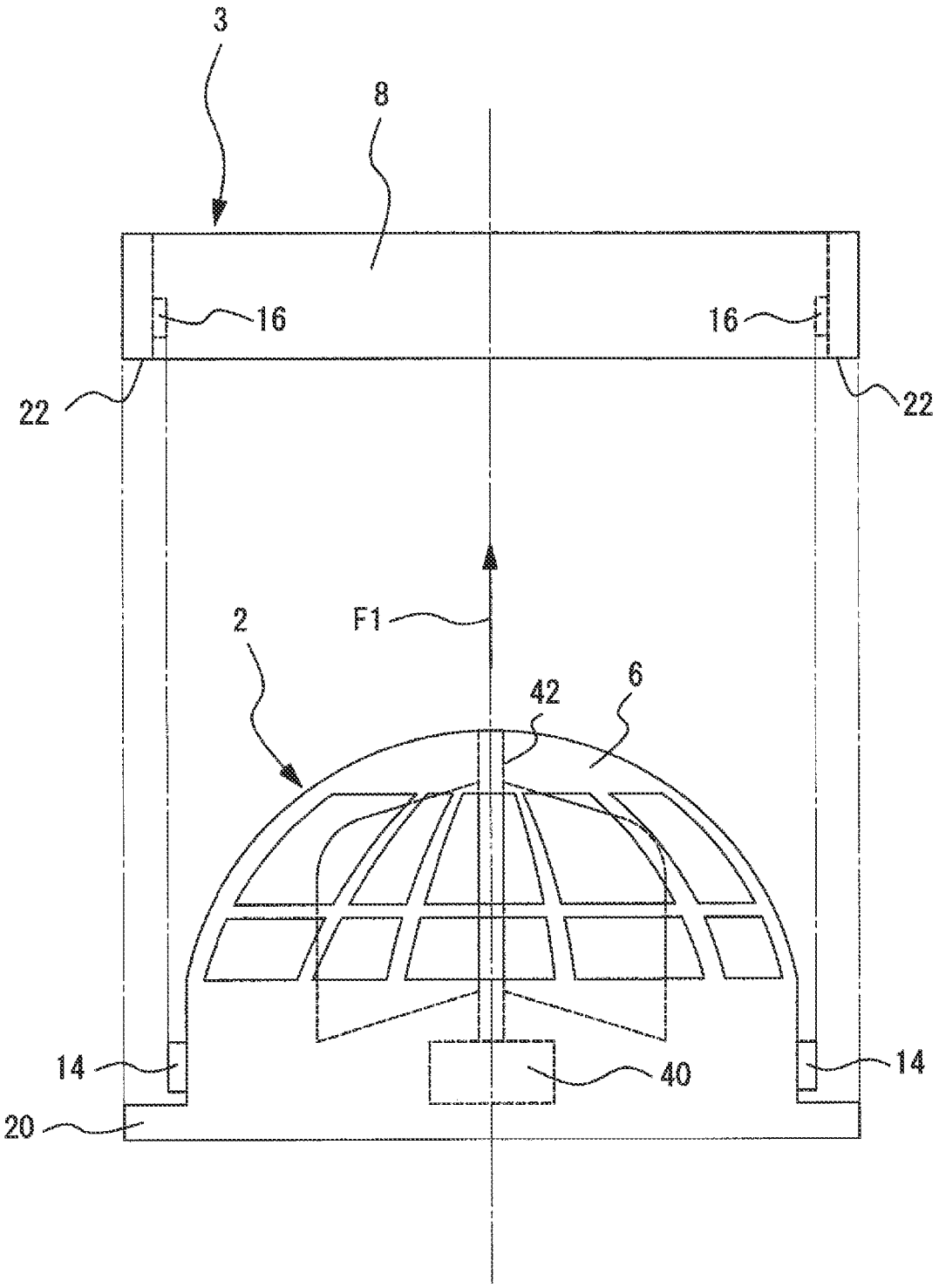
FIG. 7 illustrates one example of the configuration of the blower for the air-conditioned garment in the first embodiment.

FIG. 7 is a side view illustrating one example of the configuration of the blower 1 for the air-conditioned garment in the first embodiment. When the blower 1 for the air-conditioned garment in this embodiment is installed on the air-conditioned garment 100, the blower unit 2 is inserted in the mounting hole from the outer surface side of the air-conditioned garment 300 toward the airflow direction F1. The flange 20 (first flange) is formed in a size that abuts cloth on the peripheral edge of the mounting hole. When the flange 20 (first flange) abuts the cloth on the peripheral edge of the mounting hole, the entry of the blower unit 2 into the air-conditioned garment 100 stops.

In a state in which the flange 20 (first flange) is abutting the cloth on the peripheral edge of the mounting hole, the blower unit 2 is inserted into the through hole in the power supply unit 3 from the inner surface side of the air-conditioned garment 100. The through hole in the second housing 3 has a shape corresponding to a cross-sectional shape orthogonally intersecting the rotation shaft 42 of the first housing 6. Therefore, the blower unit 2 is inserted in the through hole in the power supply unit 3, and the blower unit 2 and the power supply unit 3 are satisfactorily engaged with each other.

When the blower unit 2 and the power supply unit 3 are engaged with each other, the first contact parts 14 and the second contact parts 16 abut each other. As a result, power is supplied to the blower unit 2 from the power supply unit 3. The power is supplied to the blower unit 2 from the power supply unit 3 without passing through a cable, and hence there is no fear of damage to the cable regardless of the movement of the wearer of the air-conditioned garment 100, and the power can be stably supplied. The first contact parts 14 and the second contact parts 16 press each other, and hence the engagement between the blower unit 2 and the power supply unit 3 becomes stronger.

The second housing 8 includes a receiving part 22 (first receiving part). When the blower 1 for the air-conditioned garment is installed on the air-conditioned garment 100, the receiving part 22 (first receiving part) and the flange 20 (first flange) sandwich the cloth on the peripheral edge of the mounting hole therebetween. As a result, the blower 3 for the air-conditioned garment can be satisfactorily installed without falling off from the air-conditioned garment 100.

In this embodiment, in the blower unit 2, an operation unit that controls OK/OFF of the motor is disposed on the rear side of the first housing 6 with respect to the airflow direction F1. When the blower 1 for the air-conditioned garment is installed on the air-conditioned garment 100, the operation unit is exposed to the outer surface side. Therefore, the switching operation of ON/OFF of the blower 1 for the air-conditioned garment can be easily performed.

Second Embodiment

Figure 8:
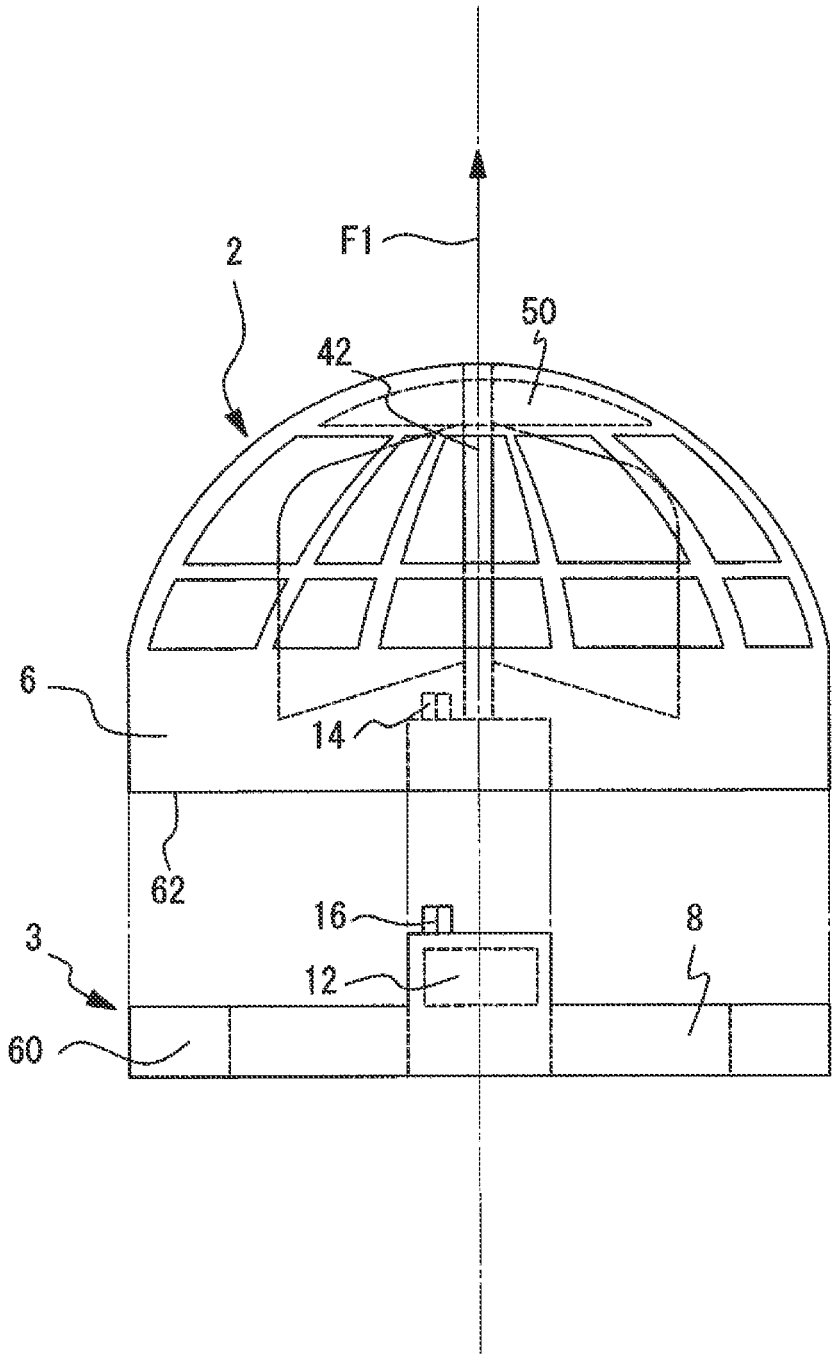
FIG. 8 illustrates one example of the configuration of a blower for an air-conditioned garment in a second embodiment.

FIG. 8 is a side view illustrating the blower 1 for an air-conditioned garment in a second embodiment of the present invention. In the second embodiment, the blower unit 2 includes the first housing 6 that houses a fan. The first housing 6 includes a motor storage part 50 near a steeple part of a dome shape. In the first housing 6, the motor storage part 50 is connected to one end side of the rotation shaft 42.

The first contact part 14 is included on an opposite-side end part of the rotation shaft 42. In the second embodiment, the first contact part 14 is a pinhole including electrically-conductive metal. The first contact part 14 is formed on the rear side with respect to the airflow direction F1. The first contact part 14 is formed in a position corresponding to the second contact part 16 formed on the second housing 8.

The power supply unit 3 includes the second housing 8. In the second embodiment, the second housing 8 includes the holding part 12 that accommodates the battery 10 at a place near a central part on the front surface side and includes the second contact part 16. The second contact part 16 is formed in a position corresponding to the first contact part 14 at a place near a central part on the front surface side. The holding part 12 is formed so as to protrude in the front direction at a place near the center on the front surface side.

In the second embodiment, the second housing 3 includes a flange 60 (second flange) extending from the center of a rear part. The first housing 6 includes a receiving part 62 (second receiving part) that can abut the flange 60.

A method of installing the blower 1 for the air-conditioned garment in the second embodiment on the air-conditioned garment 100 is described. The blower unit 2 is arranged on the inner surface side across a mounting hole in the air-conditioned garment 100, and the power supply unit 3 is arranged on the outer surface side across the mounting hole in the air-conditioned garment 100. The holding part 12 and the second contact part 16 formed near the central part of the second housing 3 are inserted in the mounting hole, and the second contact part 16 and the first contact part 14 arranged on the inner surface side of the air-conditioned garment 100 are caused to abut each other.

A back surface of the first housing 6 has a shape that is engageable with a front surface of the second housing 8 including the holding part 12. Therefore, the front surface of the second housing 8 is engaged with the back surface of the first housing 6, and the first contact part 14 and the second contact part 16 abut each other. Power can be supplied through the first contact part 14 and the second contact part 16 by the abutment of the first contact part 14 and the second contact part 16 without passing through a cable. As a result, power can be supplied from the power supply unit 3 to the blower unit 2 without passing through a cable, and hence damage to the cable does not occur regardless of the movement of the wearer of the air-conditioned garment 100, and the power can be stably supplied.

The flange 60 (second flange) has a larger size than the mounting hole. Therefore, the flange 60 (second flange) abuts cloth on the peripheral edge of the mounting hole. The receiving part 62 (second receiving part) and the flange 60 (second flange) sandwich the cloth on the peripheral edge of the mounting hole therebetween. Therefore, by engaging the blower unit 2 and the power supply unit 3 with each other across the mounting hole, the blower 1 for the air-conditioned garment can be installed on the air-conditioned garment 100 in a simple manner, and the falling off from the air-conditioned garment 100 can be prevented.

Figure 9:
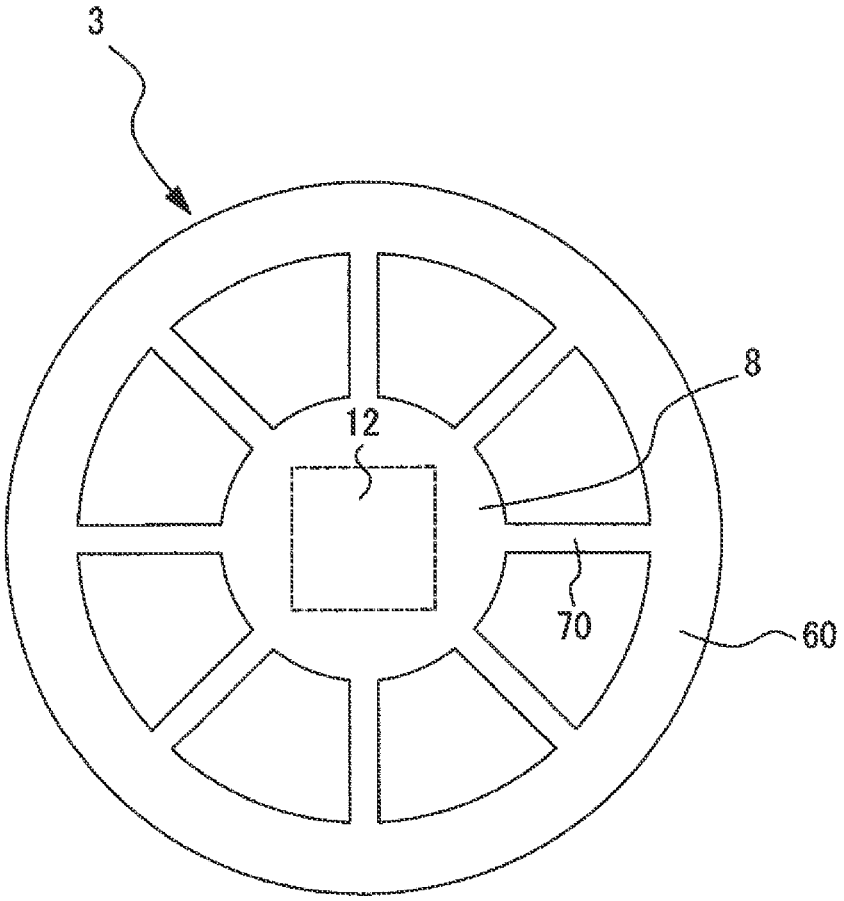
FIG. 9 is a rear view of a power supply unit in the second embodiment.

FIG. 9 is a rear view of the power supply unit 3 in the second embodiment. The second housing 8 includes the holding part 12 at a place near the central part and a plurality of spokes 70 radially extending from the center. The flange 60 (second flange) extends outside of outer-side end parts of the spokes 70 in a continuous manner.

Ventilatable gaps are formed between the spokes 70, and hence air is sucked in the direction of the fan through those gaps in accordance with the rotation of the fan. The flange 60 (second flange) is formed to be able to abut the receiving part 62 (second receiving part) and has a predetermined width. The diameter of a back surface of the second housing 8 in the second embodiment is larger than the diameter of the mounting hole in the air-conditioned garment 100.

Therefore, the flange 60 (second flange) abuts the cloth on the peripheral edge of the mounting hole when being installed on the air-conditioned garment 100. The receiving part 62 (second receiving part) of the blower unit 2 is disposed in a position that can abut the flange 60 (second flange) from the inner surface side across the mounting hole, and hence the cloth on the peripheral edge of the mounting hole is sandwiched between the flange 60 (second flange) and the receiving part 62 (second receiving part).

In the second embodiment, the second housing 8 may include a light-emitting part on the rear surface side with respect to the airflow direction F1. As one example, by arranging an LED lamp in a predetermined position on the rear surface side of the second housing 9, the light-emitting part emits light by power supplied from the battery 10. Alternatively, by applying fluorescent paint or phosphorescent paint, in a predetermined position on the rear surface side of the second housing 8, the light-emitting part may reflect or radiate light instead.

Third Embodiment

Figure 10:
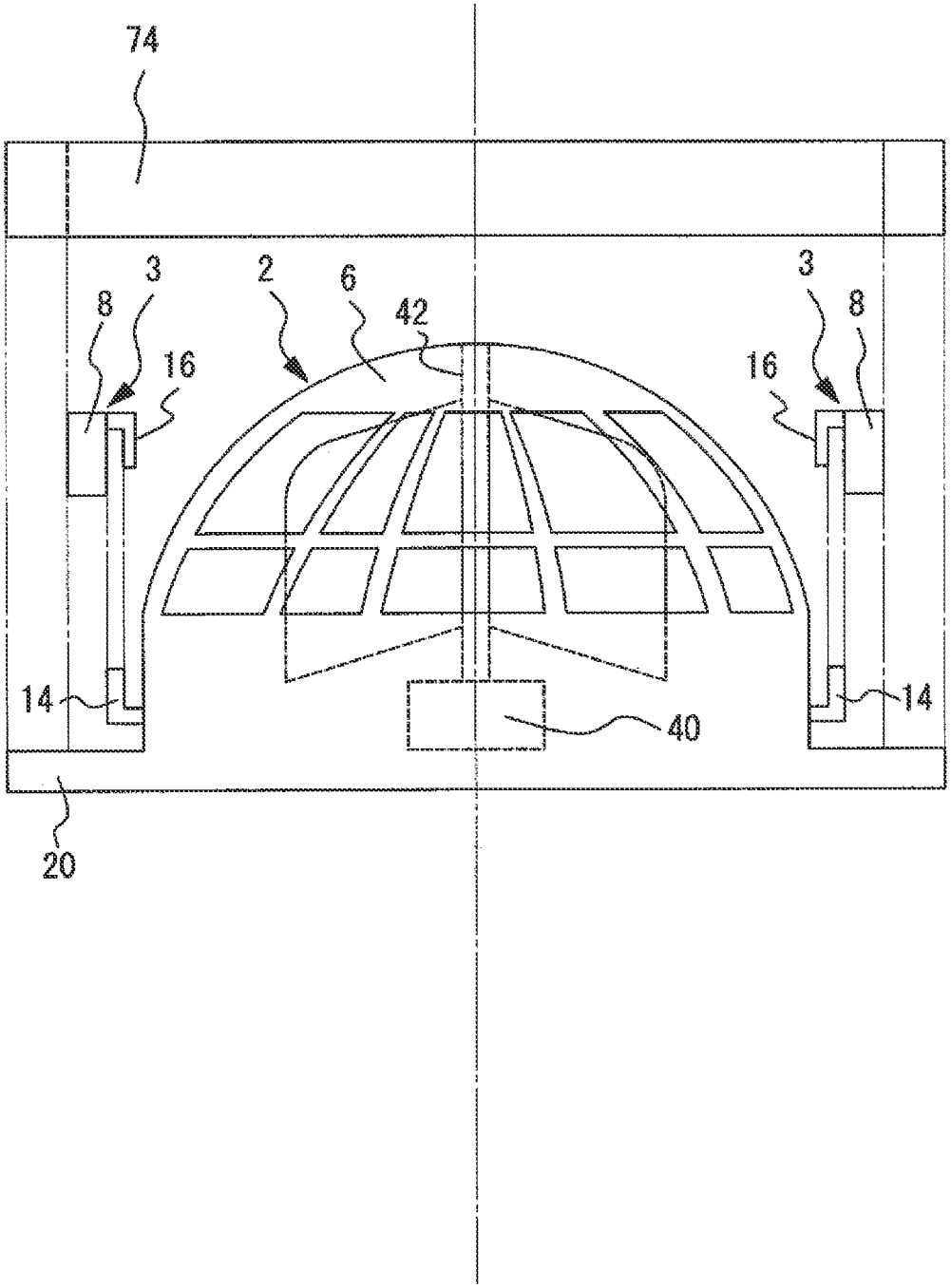
FIG. 10 illustrates one example of the configuration of a blower for an air-conditioned garment in a third embodiment.

FIG. 10 is a side view of the blower 1 for an air-conditioned garment in a third embodiment of the present, invention. The blower 1 for the air-conditioned garment in the third embodiment includes the blower unit 2, the power supply unit 3 that supplies power to the blower unit 2, and a fastening ring 74 that sandwiches cloth on the peripheral edge of a mounting hole in the air-conditioned garment 100 with the flange 20 (first flange) therebetween.

The blower unit 2 includes the first housing 6 that houses a fan. The first housing 6 includes the first contact parts 14 in predetermined positions on a side surface. The first contact, parts 14 in the third embodiment, are made of electrically-conductive metal to each have a nook-like shape.

The first housing 6 may include an accommodation part (not shown) that accommodates an object made of fiber such as cloth moistened with medical agents such as deodorant and insect repellent at a place near a steeple part of a dome shape. The accommodation part includes a ventilation part on the outer side. By disposing the accommodation part on the front side of the fan with respect to the airflow direction F1, the particles of the medical agent can be satisfactorily diffused by the airflow generated by the rotation of the fan.

The power supply unit 3 includes the second housing 9 that houses the battery 10. The second housing 8 includes the second contact parts 16 engageable with the first contact parts 14 of the first housing 6. The second contact parts 16 each have a hook-like shape protruding outward from the second housing 8 and are configured to be engaged with the first contact parts 14. The second housing 8 is engaged with the first housing 6 when the second contact parts 16 are engaged with the first contact parts 14.

The fastening ring 74 has a ring-like shape having a hole in the central part. In a state in which the first housing 6 and the second housing 8 are engaged with each other, the first housing 6 can be inserted into the hole of the fastening ring 74 from the front side. The hole of the fastening ring 74 corresponds to a cross-sectional shape orthogonally intersecting with the rotation shaft 42 of the first housing 6.

When the first housing 6 is inserted into the fastening ring 74, the flange 20 (first flange) abuts the fastening ring 74. When the blower 1 for the air-conditioned garment in the third embodiment is installed on the air-conditioned garment 100, the first housing 6 is inserted into the mounting hole from the outer surface side of the air-conditioned garment 100. The flange 20 of the first housing 6 is formed to have a larger diameter than the mounting hole, and hence abuts the cloth on the peripheral edge of the mounting hole.

Insertion of the first housing 6 into the hole of the fastening ring 74 from the inner surface side of the air-conditioned garment 100 can allow the cloth on the peripheral edge of the mounting hole to be sandwiched between the fastening ring 74 and the flange 20 (first flange). As a result, the blower 1 for the air-conditioned garment can be installed on the air-conditioned garment 100, and the falling off from the air-conditioned garment 100 can be prevented.

Fourth Embodiment

Figure 11:
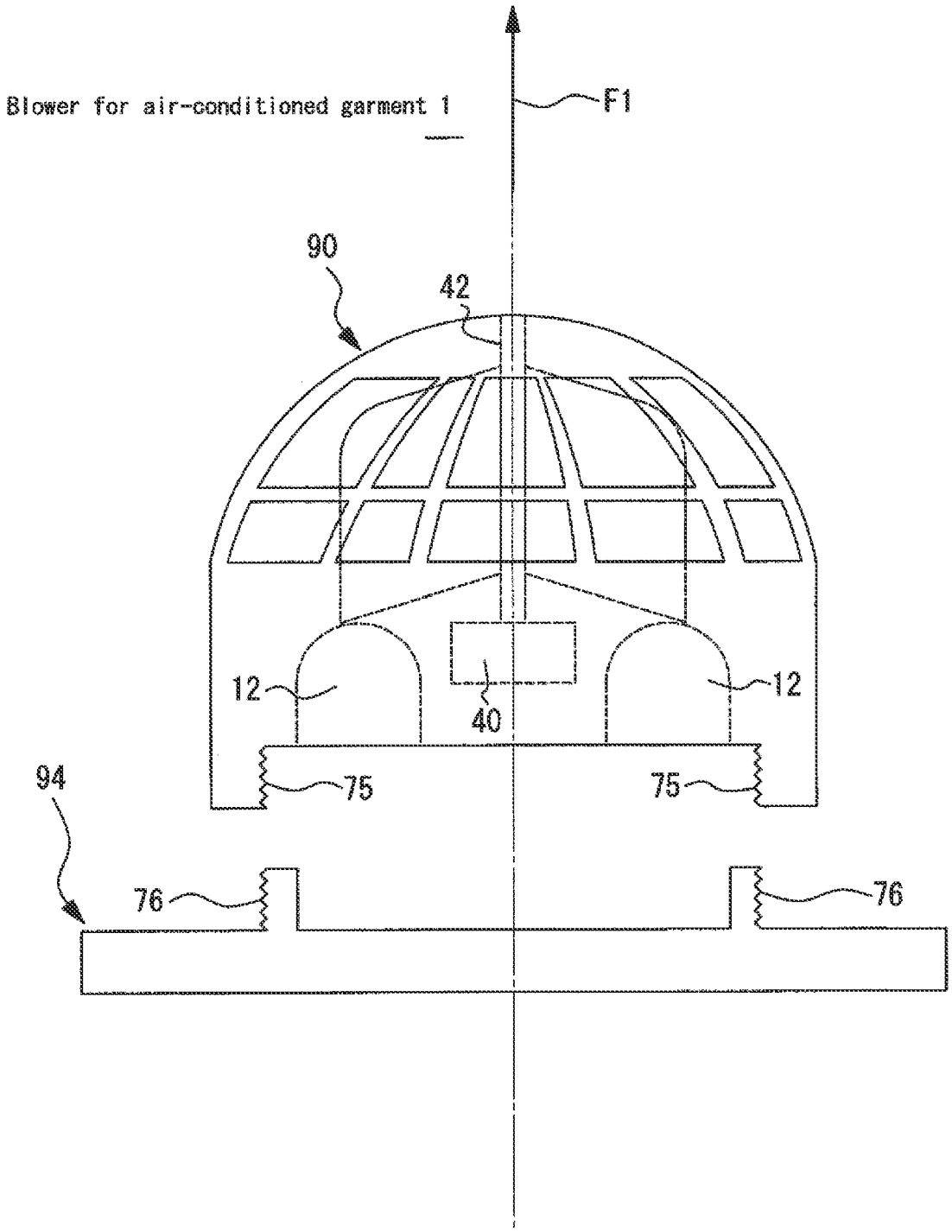
FIG. 11 illustrates one example of the configuration of a blower for an air-conditioned garment in a fourth embodiment.

FIG. 11 illustrates the configuration of the blower 1 for an air-conditioned garment in a fourth embodiment of the present invention. In the fourth embodiment, the blower 1 for the air-conditioned garment includes a main body part 90 including a motor that drives a fan and the batteries 10 (power supply units), and a rear cover 94 engageable with the main body part 90.

The main body part 90 includes the motor storage part 40 that stores the motor therein, the holding parts 12 that house the batteries 10, and the fan disposed on the periphery of the rotation shaft 42. In this embodiment, they are stored in one housing. The motor storage part 40 and the holding parts 12 are disposed in positions that do not block the rotation of the fan. The batteries 10 and the motor are not connected to each other by a cable and the like in the housing. Therefore, with only the main body part 90, the power is not supplied to the motor, and hence the motor is not driver.

The main body part 90 includes a first locking part 75 that is configured to be engaged with a second locking part 76 formed on the rear cover 94. The first locking part 75 is a thread groove formed in an inner surface of the housing, for example. The first locking part 75 may be formed in an outer surface of the housing instead.

The rear cover 94 is a member that is engaged with the rear surface side of the main body part 90 with respect to the airflow direction F1, and protects components such as the motor disposed in the housing of the main body part 90 by occluding the rear surface side of the main body part 90. The rear cover 94 includes the second locking part 76 in a position corresponding to the first locking part 75 of the main body part 90. The second locking part 76 is a thread groove having a shape corresponding to the first locking part 75.

When the main body part 90 and the rear cover 94 are engaged with each other, cloth on the peripheral edge of a mounting hole formed in the air-conditioned garment 100 is sandwiched in a section at which the main body part 90 and the rear cover 94 abut each other. As a result, when the blower 1 for the air-conditioned garment in this embodiment is installed on the air-conditioned garment 100, the falling off from the air-conditioned garment 100 is suppressed.

The main body part 90 and the rear cover 94 may have shapes that fit together instead. In this case, the main body part 90 does not necessarily need to include the first locking part 75, and the rear cover 94 does not necessarily need to include the second locking part 76.

Figure 12:
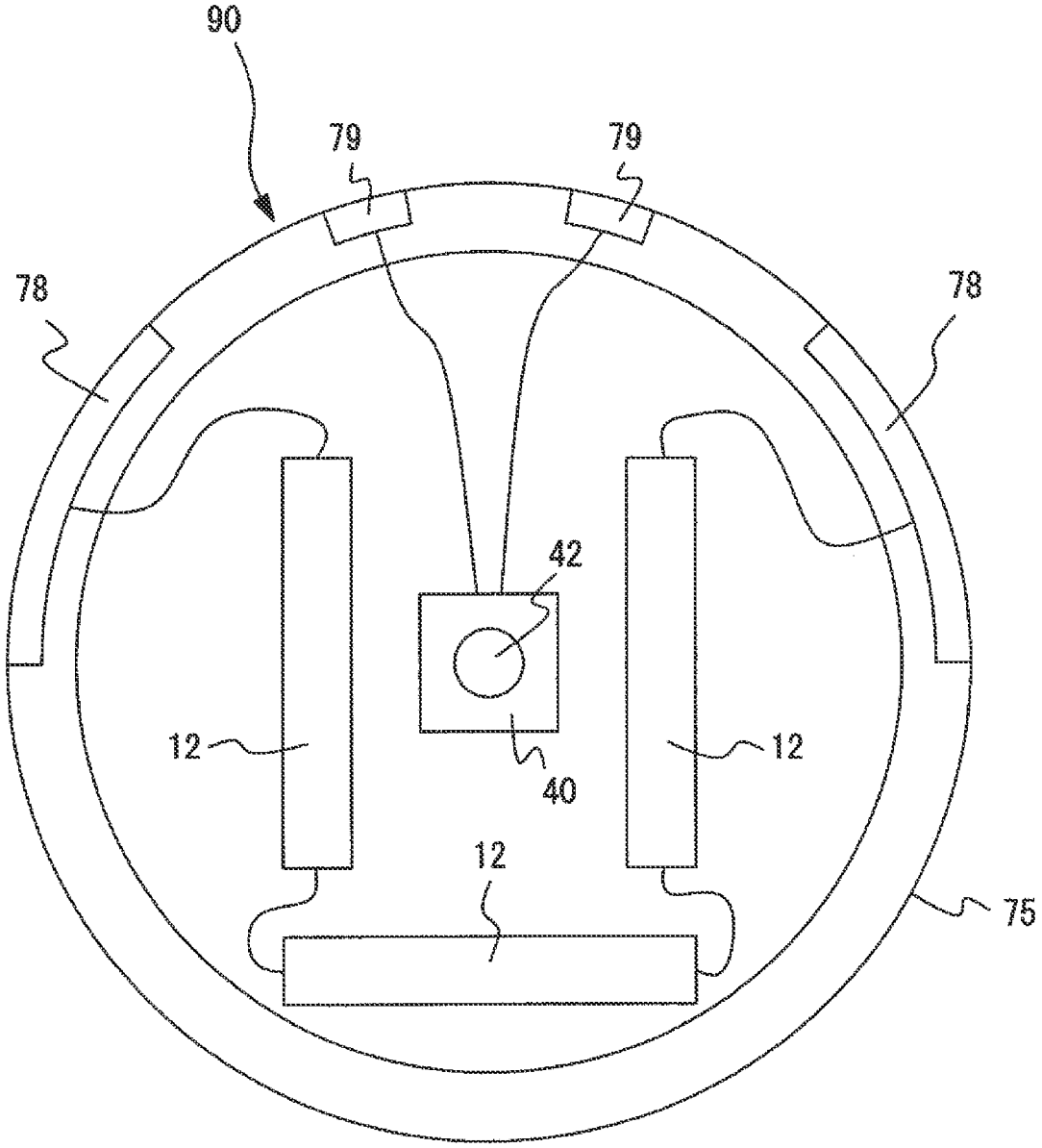
FIG. 12 is a front view of a blower unit in the fourth embodiment.

FIG. 12 is a front view of the main body part 90 in the fourth embodiment. As described above, the main body part 90 includes the motor storage part 40 and the holding parts 12 in the housing. The main body part 90 includes the first locking part 75 on the inner periphery of the housing.

The main body part 90 includes third contact parts 78 connected to the holding parts 12 that house the batteries 10 by cables. The third contact parts 78 are made of metal and the like through which power can be supplied and are disposed in predetermined positions in the first locking part 75.

The main body part 90 includes fourth contact parts 79 connected to the motor stored in the motor storage part 40 by cables. The fourth contact parts 79 are made of metal and the like through which power can be supplied. The fourth contact parts 79 are disposed in positions that do not come into contact with the third contact parts 78 in the first locking part 75.

Figure 13:
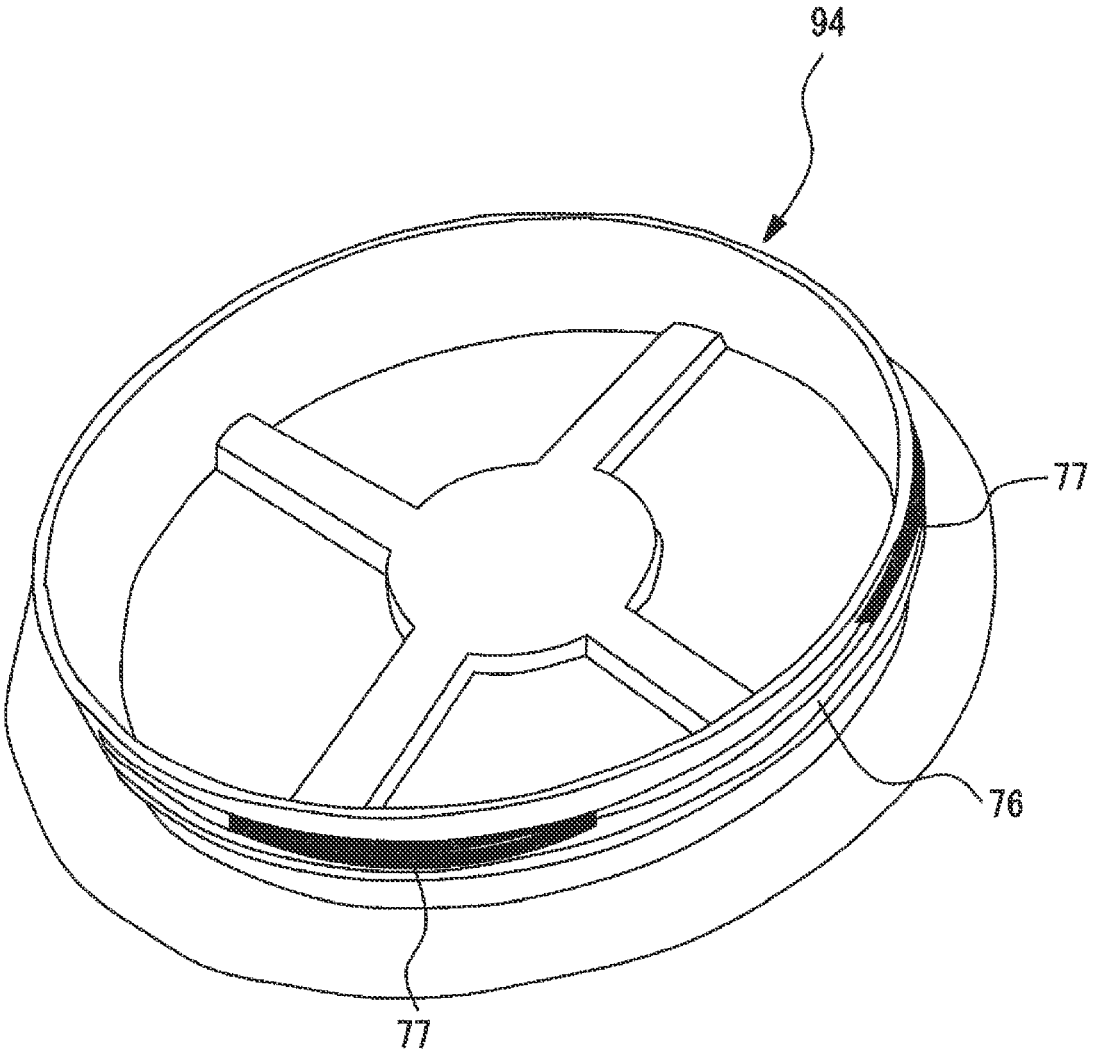
FIG. 13 is a perspective view of a rear cover in the fourth embodiment.

FIG. 13 is a perspective view of the rear cover 94 in the fourth embodiment. The rear cover 94 is engaged with the main body part 90 from the rear surface side. The rear cover 94 includes the second locking part 76 composed of a thread groove, and the second locking part 76 is engageable with the first locking part 75.

The rear cover 94 includes electrically-conductive parts 77 that abut the third contact parts 78 and the fourth contact parts 79. The electrically-conductive parts 77 are disposed in positions corresponding to the third contact parts 78 and the fourth contact parts 79. The electrically-conductive parts 77 abut the third contact parts 78 and abut the fourth contact parts 79 when the main body part 90 and the rear cover 94 are engaged with each other. The electrically-conductive parts 77 are made of metal and the like through which power can be supplied.

The electrically-conductive parts 77 are disposed in the second locking part 76. The electrically-conductive parts 77 are disposed in positions corresponding to the third contact parts 78 and the fourth contact parts 79 in the second locking part 76. In other words, the electrically-conductive parts 77 abut the third contact parts 78 and the fourth contact parts 79 when the first locking part 75 and the second locking part 76 are engaged with each other.

When the first locking part 75 and the second locking part 76 are engaged with each other when the electrically-conductive parts 77 are disposed in the second locking part 76 and the third contact parts 79 and the fourth contact parts 79 are disposed in the first locking part 75, the electrically-conductive parts 77 abut the third contact parts 73 and the fourth contact parts 79. As a result, even when positioning for causing the electrically-conductive parts 77 to abut the third contact parts 78 and the fourth contact parts 79 is not performed, it is sufficient when the first locking part 75 and the second locking part 76 are engaged with each other, and the efficiency of the operation is increased.

When the electrically-conductive parts 77 abut the third contact parts 78 and the fourth contact parts 79, the electrically-conductive parts 77 relay power between the third contact parts 78 and the fourth contact parts 79. In other words, power is transmitted from the batteries 10 to the third contact parts 78, and the power from the third contact parts 78 reaches the fourth contact, parts 79 by the relay through the electrically-conductive parts 77. Then, the power is supplied to the motor stored in the motor storage part 40 from the fourth contact parts 79 via the cables.

Engagement of the main body part 90 and the rear cover 94 allows the power to be supplied to the motor so as to activate the motor. By separating the rear cover 94 and the main body part 90 from each other when the blower 1 for the air-conditioned garment in this embodiment is not used, the power consumption of the batteries 10 can be suppressed.

In a state in which the main body part 90 and the rear cover 94 are not engaged with each other, the rear surface side of the main body part 90 is opened. The power is not supplied to the motor in a state in which the main body part 90 is not engaged with the rear cover 94. Therefore, even when an infant inserts a finger into the inside from the opening in the main body part 90, damage to the finger due to the rotation of the fan does not occur and security is increased.

The third contact parts 78 and the fourth contact parts 79 may be disposed outside of the first locking part 75 and the electrically-conductive parts 77 may be disposed outside of the second locking part 76. The electrically-conductive parts 77 abut the third contact parts 78 and the fourth contact parts 79 when the main body part 90 and the rear cover 94 are engaged with each other.

Air-Conditioned Garment 100

Figure 14:
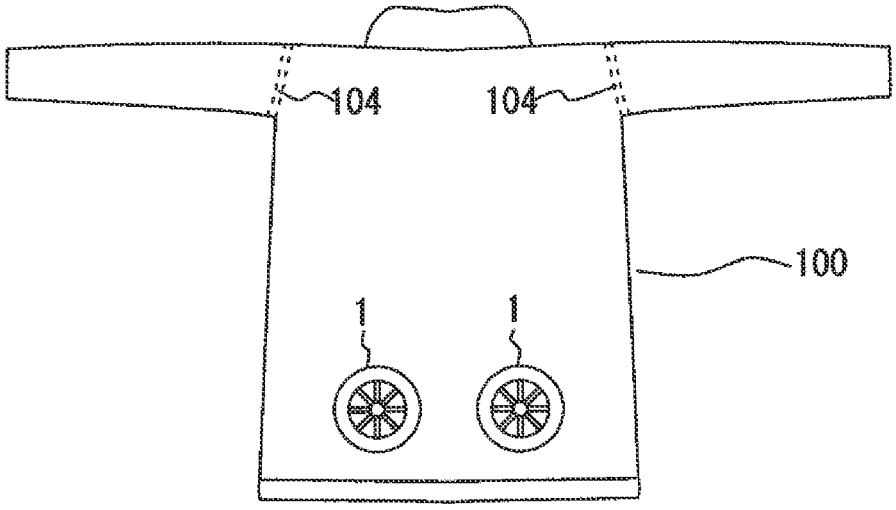
FIG. 14 illustrates one example of installation of the blower for the air-conditioned garment onto the air-conditioned garment.
Figure 14:
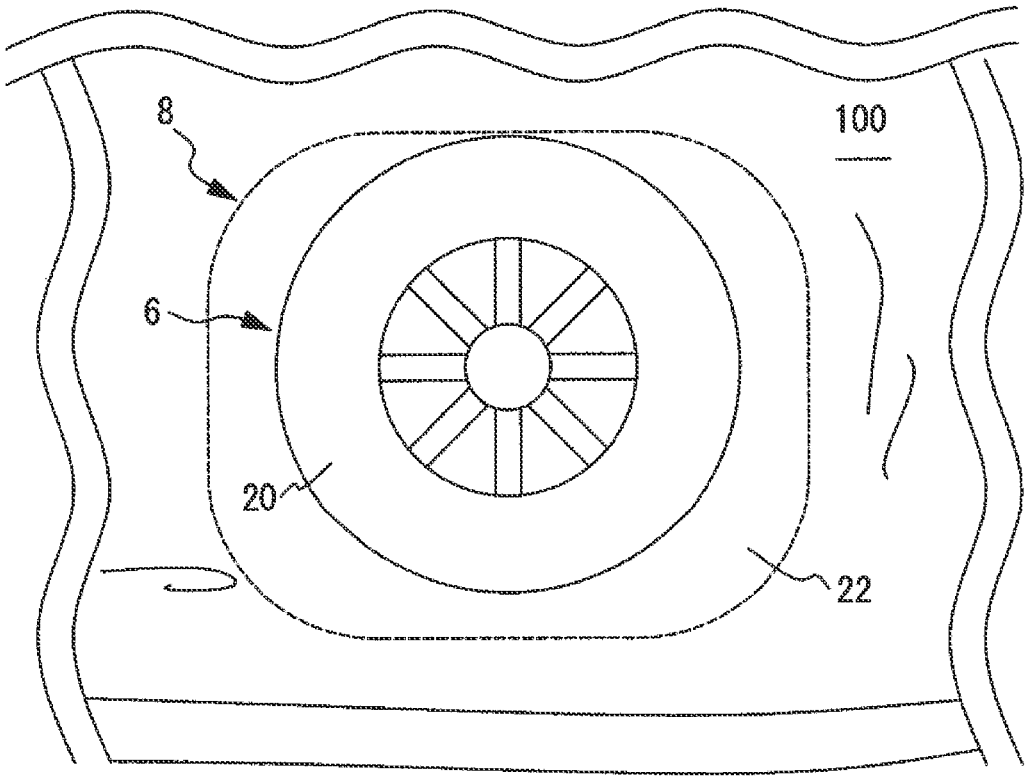

FIG. 14 illustrates one example of the air-conditioned garment 100 on which the blowers 1 for the air-conditioned garment are mounted. FIG. 14(*a*) is a rear view of the air-conditioned garment 100 in a state in which the blowers 1 for the air-conditioned garment are installed. The air-conditioned garment 100 includes mounting holes on a lower part on the rear surface side. In the illustrated example, a case where a plurality of mounting holes are included is shown, but the number of the mounting holes may be one.

When the blowers 1 for the air-conditioned garment are driven, air is sucked in from the outer side of the air-conditioned garment 100 and is discharged to the inner side of the air-conditioned garment 100. As a result, the evaporation of sweat of the wearer wearing the air-conditioned garment 100 is facilitated, and the rise in the body temperature of the wearer is suppressed.

The air-conditioned garment 100 includes narrow parts 104 (ventilation adjustment parts) near borders between shoulder parts and sleeve parts. The narrow parts 104 (ventilation adjustment parts) may be formed by sewing elastic bodies such as rubber in the sleeve parts. Alternatively, adjustment strings having the inner periphery widths may be wound around the sleeve parts. The narrow parts 104 (ventilation adjustment parts) each have a function of adjusting the air quantity that flows into the sleeve parts from a torso part of the air-conditioned garment 100.

When the inner periphery widths of the sleeve parts are narrowed by narrowing the narrow parts 104 (ventilation adjustment parts), the air quantity that flows into the sleeve parts from the torso part decreases. When the blowers 1 for the air-conditioned garment are driven, the air flows into the air-conditioned garment 100 through the blowers 1 for the air-conditioned garment, and hence the volume of the air in the air-conditioned garment 100 increases, and the air-conditioned garment 100 is inflated. When the narrow parts 104 (ventilation adjustment parts) are narrowed, the inner periphery widths of the sleeve parts become narrower. Therefore, the quantity of the air that flows into the sleeve parts can be suppressed, and hence the inflation of the sleeve parts caused by air is suppressed. As a result, the movement of the arms of the wearer can be prevented from being hampered by the inflated sleeve parts.

FIG. 14(*b*) illustrates the place in which the blower 1 for the air-conditioned garment is installed in an enlarged manner. In the illustrated example, the flange 20 (first flange) of the first housing 6 is exposed to the outer side of the air-conditioned garment 100, and the second housing 8 is hidden on the inner side of the air-conditioned garment 100.

The cloth on the peripheral edge of the mounting hole is sandwiched between the flange 20 (first flange) and the receiving part 22 (first receiving part), and hence the blower 1 for the air-conditioned garment is satisfactorily installed. An operation unit that controls the driving of the motor may be mounted on the rear surface side of the first housing 6. By including the operation unit in a place that is exposed from the air-conditioned garment 100, the wearer can easily perform the operation.

Modification

The embodiments relating to the present invention have been described above, but the present invention is not limited to the configurations described in the above-mentioned embodiments and can be applied to various modifications.

For example, in the above-mentioned embodiments, a case where the accommodation part 32 accommodates cloth and the like moistened with a medical agent has been described. However, the present invention is not limited thereto, and the first housing 6 may include a medical agent arranging part in which cloth and the like moistened with a medical agent can be arranged. As one example, the medical agent arranging part is included on the front surface side of the first housing 6 on the front side with respect to the airflow direction F1 and is made of a flat-plate-like resin on which cloth can stick. The medical agent arranging part may have a ventilation hole.

For example, in the above-mentioned embodiments, a case where the blower unit 2 and the power supply unit 3 are engaged with each other by fitting the first housing 6 and the second housing 8 together has been described. However, the present invention is not limited thereto, and a thread member, for example, may be used in order to engage the blower unit 2 and the power supply unit 3 with each other.

Fifth Embodiment

Figure 15:
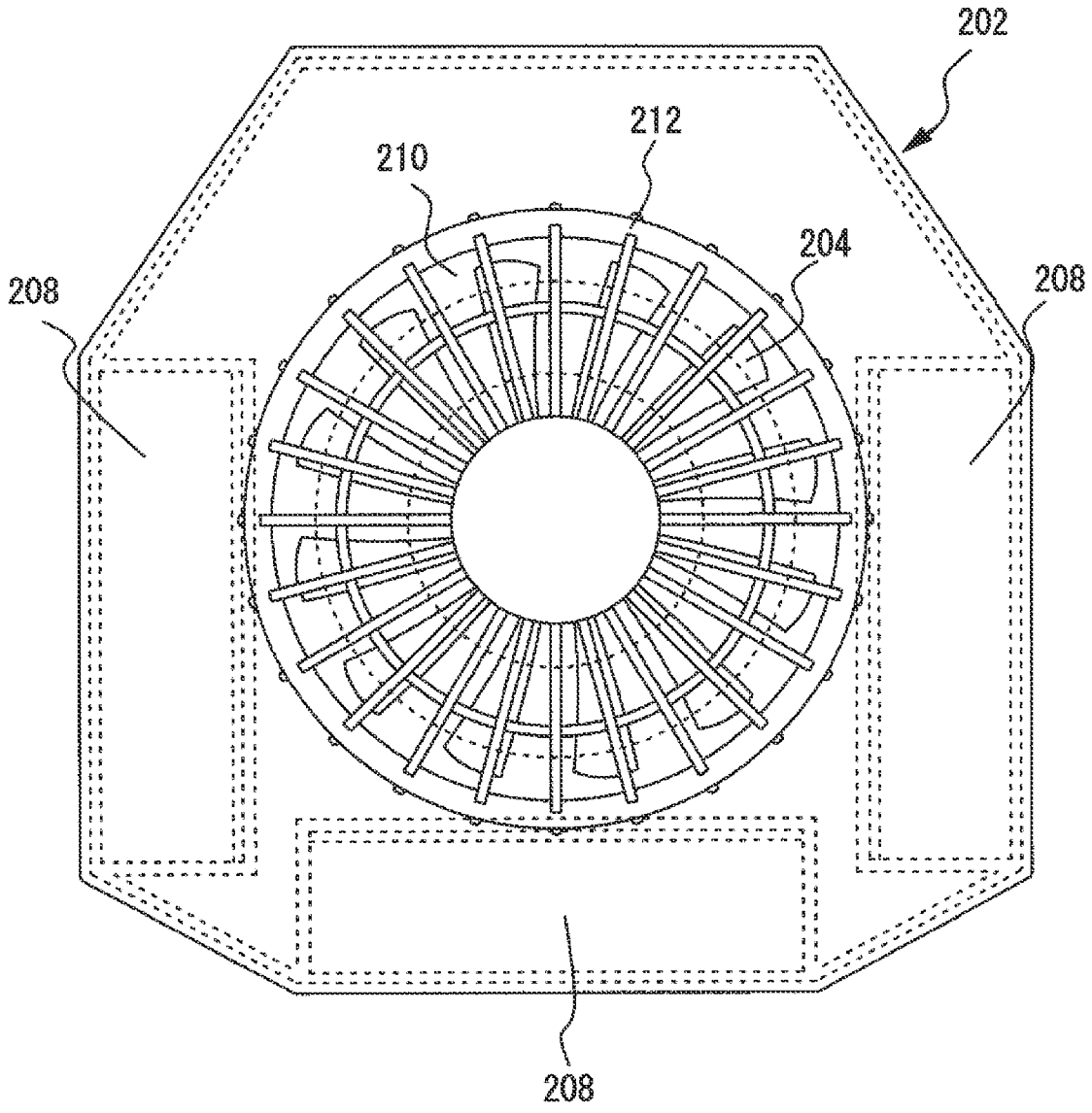
FIG. 15 illustrates one example of the configuration of the blower for the air-conditioned garment in a fifth embodiment.

FIG. 15 is a front view illustrating a blower 200 for an air-conditioned garment in one embodiment of the present invention. The blower 200 for the air-conditioned garment is used by being installed on the air-conditioned garment 100. The blower 200 for the air-conditioned garment is installed on the air-conditioned garment 100 by being inserted in a mounting hole formed in the air-conditioned garment 100. In a fifth embodiment, the blower 200 for the air-conditioned garment includes an axial blower and a centrifugal blower. One example in which the blower 200 for the air-conditioned garment is an axial blower is described below.

The blower 200 for the air-conditioned garment includes a main body part 202 including a fan 204 and a motor 206 that drives the fan 204. The blower 200 for the air-conditioned garment includes a rear frame 203 installed from the rear surface side of the main body part 202. As described below, in the blower 200 for the air-conditioned garment, the air-conditioned garment 100 is sandwiched between the main body part 202 and the rear frame 203.

The main body part 202 includes the fan 204 and batteries 208 that supply power to the motor 206 that drives the fan 204. The batteries 208 are composed of storage batteries, for example. One battery 208 may be disposed or a plurality of the batteries 208 may be disposed in the main body part 202.

The batteries 208 are disposed on the outer side of the outer diameter of the fan 204 in a front view. The batteries 208 are disposed on the outer side with respect to the outer diameter of the fan 204 in the direction of a rotation shaft 207 of the fan 204. In other words, the batteries 208 are disposed on the outer side of the airflow generated when the fan 204 rotates. As a result, gas can be efficiently sent into the air-conditioned garment without blocking the airflow generated by the rotation of the fan 204.

The batteries 208 may be disposed so as to be unevenly distributed on the outer side with respect to the outer diameter of the fan 204 in the direction of the rotation shaft 207. The batteries 208 may be disposed such that the longitudinal direction thereof is close to the outer periphery of the fan 204. By disposing the batteries 208 on the outer side with respect to the outer diameter of the fan 204 in an unevenly distributed manner, the center of gravity that is separated from the rotation shaft 207 by a predetermined distance is placed on the lower side and the blower 200 for the air-conditioned garment becomes stable when the blower 200 for the air-conditioned garment is installed on the air-conditioned garment 100.

When the fan 204 is rotated, a case where the blower 200 for the air-conditioned garment itself rotates in a state of being installed on the air-conditioned garment 100 in accordance with the rotation of the fan 204 can be satisfactorily suppressed.

A fan cover 212 is disposed on the front side of the fan 204. The fan cover 212 is disposed on the front side with respect to the fan 204. In the example in FIG. 15, the fan cover 212 is formed to be ventilatable by a frame radially extending from the center.

On the front side of the fan 204, an exhaust port 210 is formed. The exhaust port 210 discharges gas pushed out to the front side by the rotation of the fan 204.

Figure 16:
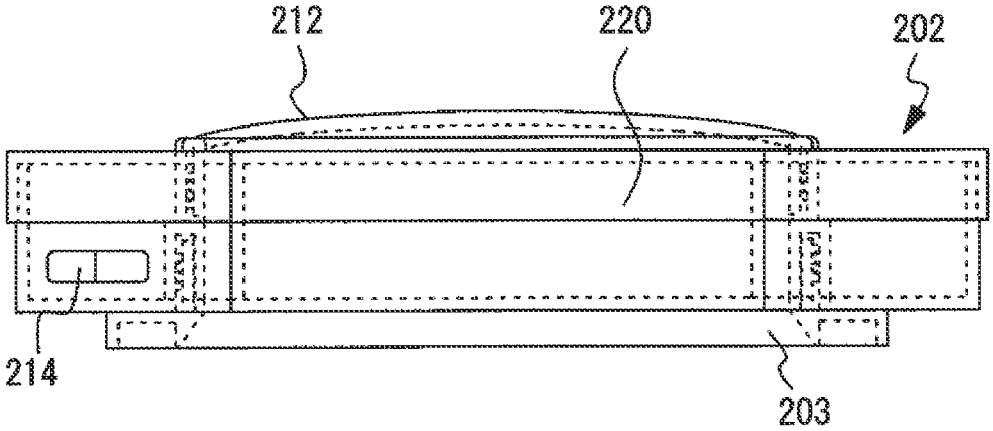
FIG. 16 is a side view of the blower for the air-conditioned garment in the fifth embodiment.
Figure 16:
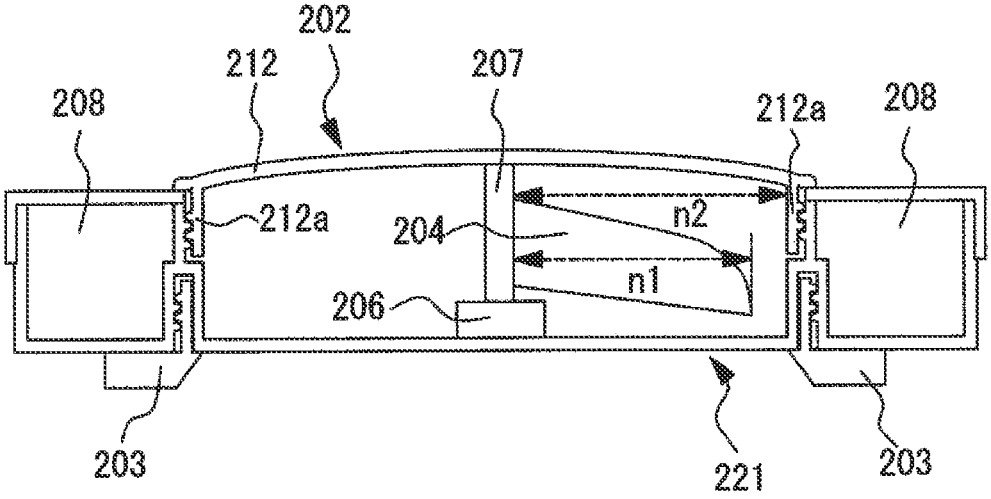

FIG. 16 illustrates one example of the configuration of the blower 200 for the air-conditioned garment in this embodiment seen from a side surface.

FIG. 16(*a*) is one example of a side view of the blower 200 for the air-conditioned garment in this embodiment. The main body part 202 has a through hole 220 at a place substantially near the center. The fan 204 and the motor 206 are arranged in the through hole 220. The fan cover 212 is disposed on the front side of the through hole 220. The fan cover 212 is detachably engaged with the main body part 202.

The main body part 202 includes an operation switch 214. The operation switch 214 inputs a signal to a control unit 222 that controls the driving of the motor 206. For example, the operation switch 214 includes a switch for switching ON/OFF of the motor 206, and a switch for switching the rotation speed of the motor 206.

The operation switch 214 and the control unit 222 are connected to each other by a cable and the like in the main body part 202. In other words, the cable is hidden without being exposed to the outside of the main body part 202, and hence damage to the cable due to the movement of the wearer of the air-conditioned garment 100 can be satisfactorily avoided.

The rear frame 203 is detachably engaged with the rear surface side of the main body part 202. The rear frame 203 includes a suction port 221 that is substantially the same size as the through hole 220.

FIG. 16(*b*) is one example of a side cross-sectional view of the blower 200 for the air-conditioned garment in this embodiment.

When the rear frame 203 is engaged with the main body part 202, the suction port 221 is included on the rear side of the through hole 220. An inner peripheral wall of the rear frame 203 is formed so as to gradually expand toward the rear side. The suction port 221 has an inner diameter that gradually expands toward the rear side in the flow direction of the gas. As a result, when the fan 204 rotates, the resistance when the gas is sucked in can be reduced.

The inner diameter of the inner peripheral wall of the rear frame 203 may be substantially the same without gradually expanding instead.

The fan cover 212 is engaged with the main body part 202 at an inner peripheral wall of the through hole 220. The fan cover 212 further includes an engaging part 212*a*. The engaging part 212*a* is engaged with an inner-peripheral side surface of the through hole 220. The fan 204 is integrally formed with the rotation shaft 207. A length (n1) of the fan 204 from the rotation shaft 207 is shorter than a length (n2) from the rotation shaft 207 to an inner peripheral wall of the engaging part 212*a*. Because n1<n2 is satisfied, a case where the fan 204 comes into contact with the engaging part 212*a* when the fan 204 rotates can be avoided.

The inner peripheral wall of the engaging part 212*a* and the part of the inner peripheral wall of the through hole 220 that is not engaged with the engaging part 212*a* may be preferably formed to be substantially flush with each other. The part of the inner peripheral wall of the through hole 220 that is engaged with the engaging part 212*a* has a larger inner diameter than the other parts of the inner peripheral wall of the through hole 220 and expands to the outer side. When the fan cover 212 is engaged with the main body part 202, the engaging part 212*a* and the part of the inner peripheral wall of the through hole 220 that is expanded to the outer side are engaged with each other. In a state in which the engaging part 212*a* and the part of the inner peripheral wall of the through hole 220 that is expanded to the outer side are engaged with each other, a level difference between the inner peripheral wall of the engaging part 212*a* and the other parts of the inner peripheral wall of the through hole 220 is minimized. As a result, the operation efficiency for disposing the fan 204 in the through hole 220 in a state in which the fan cover 212 is engaged with the main body part 202 can be increased.

Figure 17:
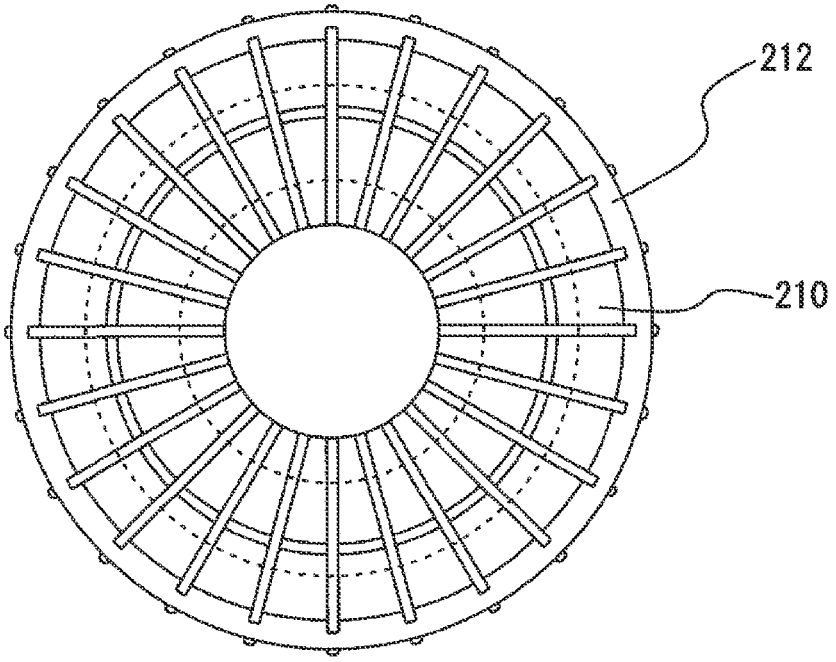
FIG. 17 illustrates one example of the configuration of a fan cover in the fifth embodiment.
Figure 17:
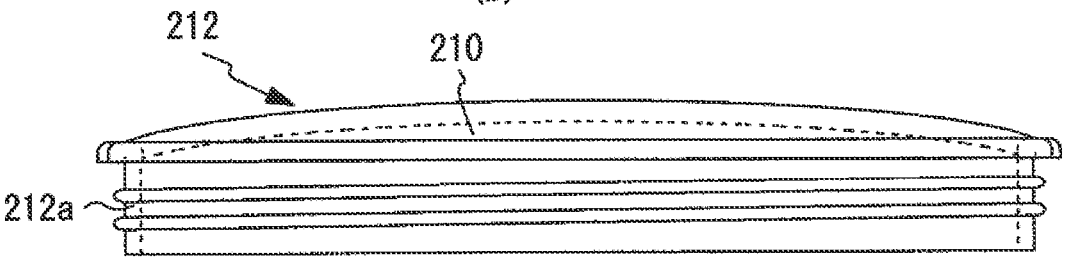

FIG. 17 illustrates one example of the fan cover 212 in this embodiment. FIG. 17(*a*) is a front view of the fan cover 212. The fan cover 212 is composed of a frame made of resin and the like and radially extending from the center. The through hole 220 is occluded from the front side. In the example in FIG. 17(*a*), the fan cover 212 has a circular shape in a front view. The length from the center to an outer edge is longer than the inner diameter of the through hole 220.

FIG. 17(*b*) is a side view of the fan cover 212. As described above, the fan cover 212 includes the engaging part 212*a* that is configured to be engaged with the inner peripheral wall of the through hole 220. The fan cover 212 includes the exhaust port 210 on the front, side in the flow direction of the gas in a manner that is continuous with the engaging part 212*a*.

The inner periphery of the exhaust port 210 is formed so as to expand to the outer side from the inner peripheral wall of the engaging part 212*a*. The exhaust port 210 is formed on the front side in the flow direction of the gas so as to be continuous from the engaging part 212*a*. An inner peripheral wall of the exhaust port 210 is formed so as to expand to the outer side. As a result, the resistance when the gas is discharged can be reduced.

FIG. 13 illustrates one example of the configuration of the blower 200 for the air-conditioned garment in this embodiment. FIG. 13(*a*) is a front view of the blower 200 for the air-conditioned garment. Three batteries 208 are disposed on the outer side with respect to the cuter diameter of the fan 204 in the main body part 202. The batteries 208 are connected to the motor 206 by cables and the like in the main body part 202 such that power can be supplied therethrough. The cables that connect the motor 206 and the batteries 206 to each other are hidden in the main body part 202.

Figure 18:
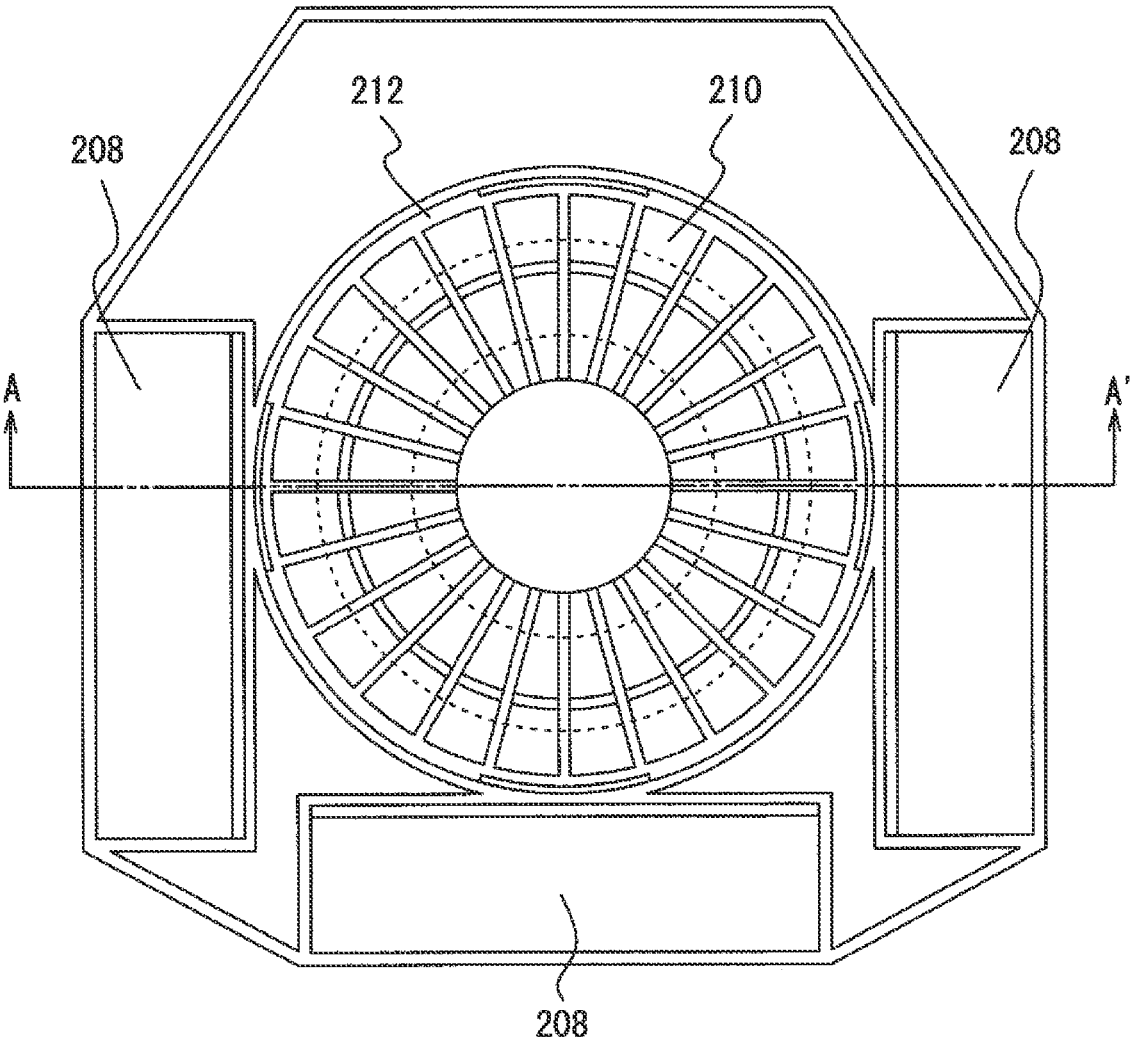
FIG. 18 illustrates one example of the configuration of the blower for the air-conditioned garment in the fifth embodiment.
Figure 18:
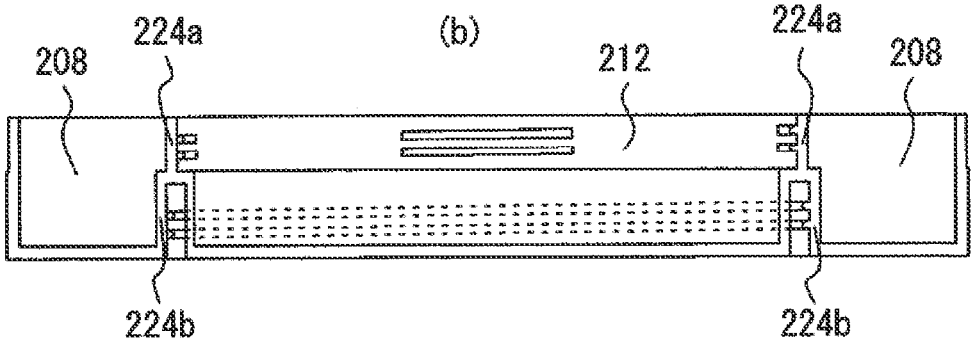

FIG. 18(*b*) is a cross-sectional view of the blower 200 for the air-conditioned garment taken along line A-A'. The main body part 202 includes a first receiving part 224*a* that is engaged with the engaging part 212*a* of the fan cover 212. The first receiving part 224*a* expands to the outer side with respect to the inner periphery of the through hole 220. As a result, when the engaging part 212*a* and the first receiving part 224*a* are engaged with each other, the diameter of the inner peripheral wall of the engaging part 212*a* becomes substantially the same as that of the inner periphery of the through hole 220.

The main body part 202 includes a second receiving part 224*b* that is engaged with the rear frame 203. The second receiving part 224*b* is included on the outer side of the through hole 220 on the rear surface side of the main body part 202. The second receiving part 224*b* is formed so as to be drawn in from a rear-surface-side end surface on the outer side of the through hole 220. As a result, when the fan cover 212 is engaged with the main body part 202, the inner peripheral wall of the through hole 220 and the inner peripheral wall of the engaging part 212*a* become substantially flush with each other, and hence the fan 204 can be satisfactorily disposed in the through hole 220.

Figure 19:
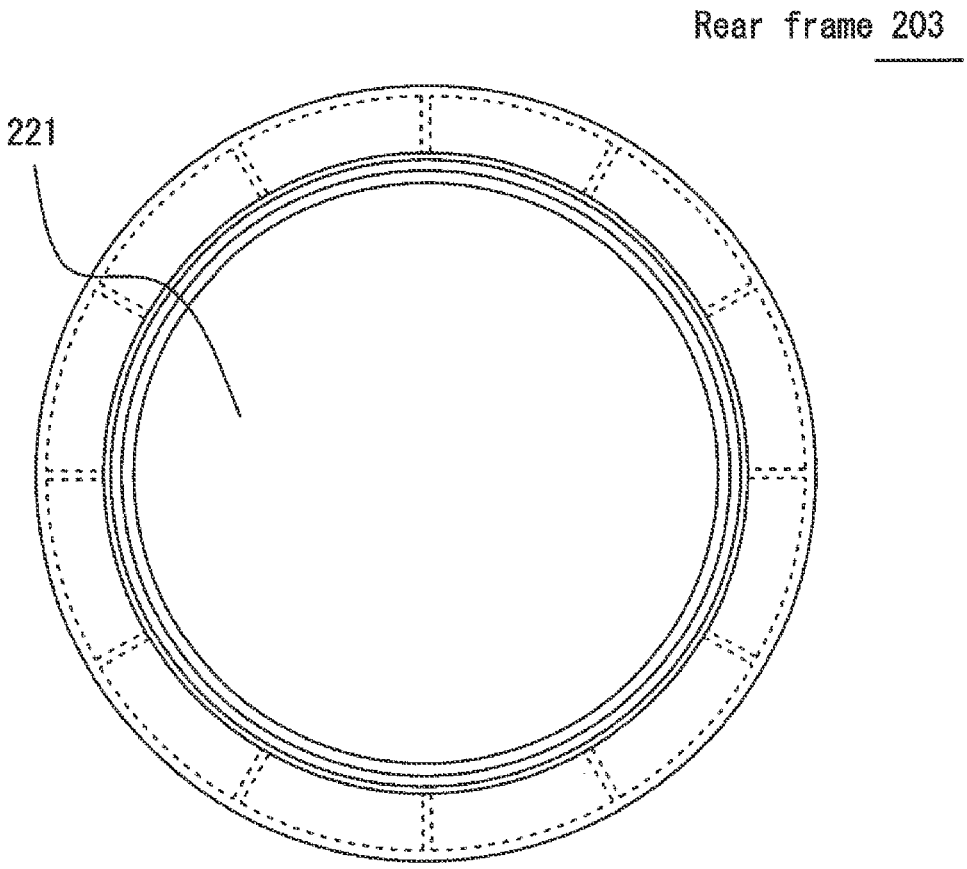
FIG. 19 illustrates one example of the configuration of a rear frame in the fifth embodiment.
Figure 19:
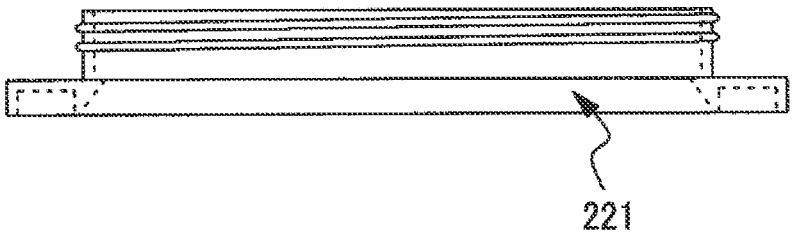

FIG. 19 illustrates one example of the configuration of the rear frame 203 in this embodiment. FIG. 19(*a*) is a front view of the rear frame 203. The rear frame 203 has a substantially circular shape. The rear frame 203 includes the suction port 221 having a substantially circular shape on the center side. The suction port 221 is formed to have substantially the same inner diameter as the through hole 220.

FIG. 19(*b*) is a side view of the rear frame 203. The suction port 221 is formed such that the inner diameter gradually expands toward the rear side with respect to the flow direction of the gas. An inner-peripheral-side end part forming the suction port 221 is formed so as to gradually expand to the outer side toward the rear side. As a result, the resistance when the gas is sucked in can be reduced.

Figure 20:
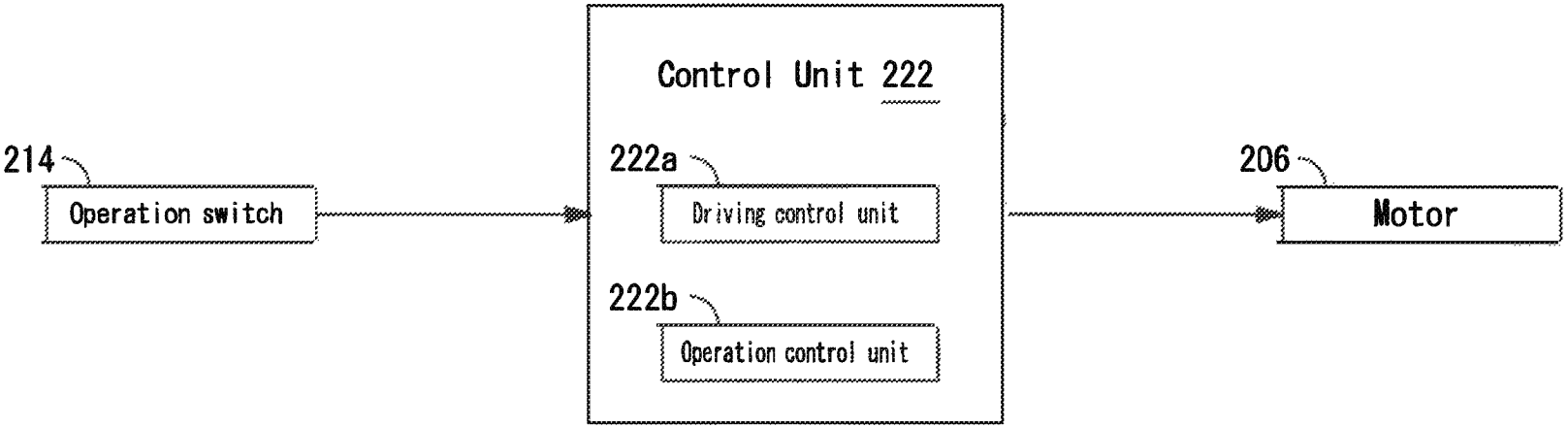
FIG. 20 is a block diagram illustrating one example of the functional configuration of a control unit in the fifth embodiment.

FIG. 20 is a block diagram illustrating one example of the functional configuration of the blower 200 for the air-conditioned garment in this embodiment. The blower 200 for the air-conditioned garment includes the control unit 222 that controls the driving of the motor 206. The operation switch 214 inputs a signal to the control unit 222 in accordance with the operation of a user. The control unit 222 controls the motor 206 in accordance with the signal input from the operation switch 214.

The control unit 222 further includes a driving control unit 222*a* that performs the switching control of ON/OFF of the motor 206, and an operation control unit 222*b* that performs the switching control of the rotation speed of the motor 206.

When a signal for driving the motor 206 is input from the operation switch 214, the driving control unit 222*a* starts the driving of the motor 206. When a signal for stopping the driving of the motor 206 is input from the operation switch 214, the driving control unit 222*a* stops the driving of the motor 206.

The operation control unit 222*b* is a processing unit that controls the switching of the rotation speed of the motor 206 in a state in which the motor 206 is being driven. The operation control unit 222*b* sets the rotation speed of the motor 206 to one of preset three stages as one example. By switching the rotation speed of the motor 206, the quantity of gas discharged into the air-conditioned garment 100 can be adjusted.

The control unit 222 may be built in the operation switch 214 or may be built in the motor 206 instead. The operation switch 214, the control unit 222, and the motor 206 are all disposed in the main body part 202. Therefore, cables that connect the above to each other can be hidden in the main body part 202, and hence a case where the cables become worn out in accordance with the movement of the body of the user wearing the air-conditioned garment 100 can be suppressed.

Figure 21:
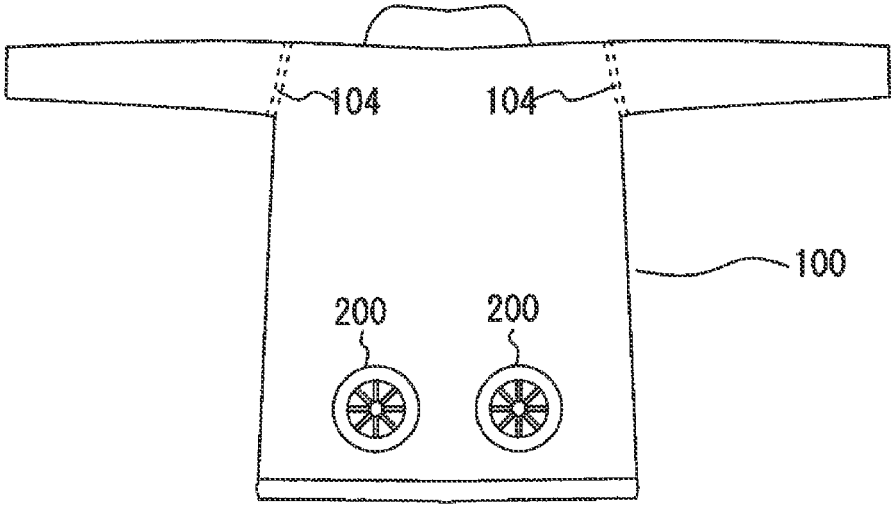
FIG. 21 illustrates one example of the configuration of the air-conditioned garment in the fifth embodiment.
Figure 21:
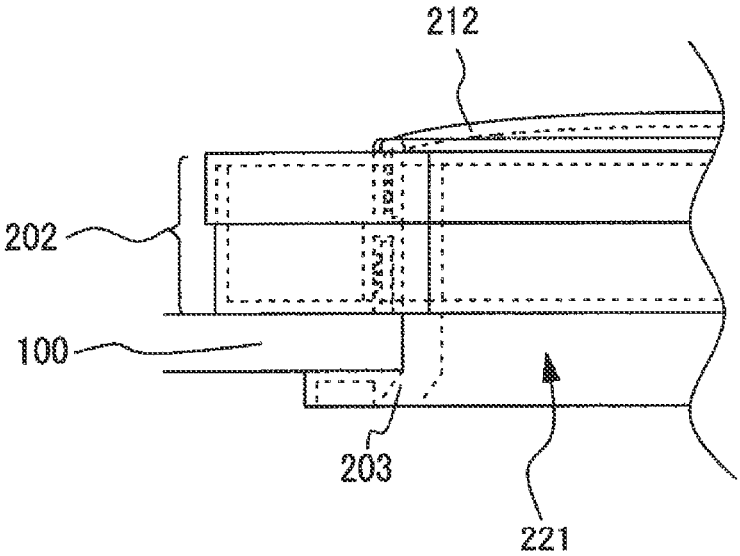

FIG. 21 illustrates one example of the air-conditioned garment 100 on which the blowers 200 for the air-conditioned garment in this embodiment are mounted. FIG. 21(*a*) is a rear view of the air-conditioned garment 100 in a state in which the blowers 200 for the air-conditioned garment are installed. The air-conditioned garment 100 includes mounting holes on a lower part on the rear surface side. In the illustrated example, a case where a plurality of mounting holes are included is shown, but the number of the mounting holes may be one.

When the motors 206 of the blowers 200 for the air-conditioned garment are driven, air is sucked in from the outer side of the air-conditioned garment 100 and is discharged to the inner side of the air-conditioned garment 100. As a result, the evaporation of sweat of the wearer wearing the air-conditioned garment 100 is facilitated, and the rise in the body temperature of the wearer is suppressed.

The air-conditioned garment 100 includes narrow parts 104 (ventilation adjustment parts) near borders between shoulder parts and sleeve parts. The narrow parts 104 (ventilation adjustment parts) may be formed by sewing elastic bodies such as rubber in the sleeve parts. Alternatively, adjustment strings having the inner periphery widths may be wound around the sleeve parts. The narrow parts 104 (ventilation adjustment parts) each have a function of adjusting the air quantity that flows into the sleeve parts from a torso part of the air-conditioned garment 100.

When the inner periphery widths of the sleeve parts are narrowed by narrowing the narrow parts 104 (ventilation adjustment parts), the air quantity that flows into the sleeve parts from the torso part decreases. When the blowers 200 for the air-conditioned garment are driven, the air in the air-conditioned garment 100 flows in through the blowers 200 for the air-conditioned garment, and hence the volume of the air in the air-conditioned garment 100 increases, and the air-conditioned garment 100 is inflated. When the narrow parts 104 (ventilation adjustment parts) are narrowed, the inner periphery widths of the sleeve parts become narrower. Therefore, the quantity of the air that flows into the sleeve parts can be suppressed, and hence the inflation of the sleeve parts caused by air is suppressed. As a result, the movement of the arms of the wearer can be prevented from being hampered by the inflated sleeve parts.

FIG. 21(*b*) illustrates one example of an aspect of the mounting of the blower 200 for the air-conditioned garment. The main body part 202 and the rear frame 203 are formed so as to sandwich the air-conditioned garment 100 therebetween. The rear frame 203 has an end part that expands to the outer side on the rear side with respect to the flow direction of the gas.

The end part of the rear frame 203 expanding to the outer side and the main body part 202 sandwich an end part of the mounting hole in the air-conditioned garment 100 when the rear frame 203 is engaged with the main body part 202. In other words, when the main body part 202 is arranged on the inner side of the air-conditioned garment 100, the rear frame 203 is arranged on the outer side of the air-conditioned garment 100, and the rear frame 203 is engaged with the main body part 202, the main body part 202 and the rear frame 203 are engaged with each other across the mounting hole in the air-conditioned garment 100. As a result, the blower 200 for the air-conditioned garment is installed on the air-conditioned garment 100.

Figure 22:
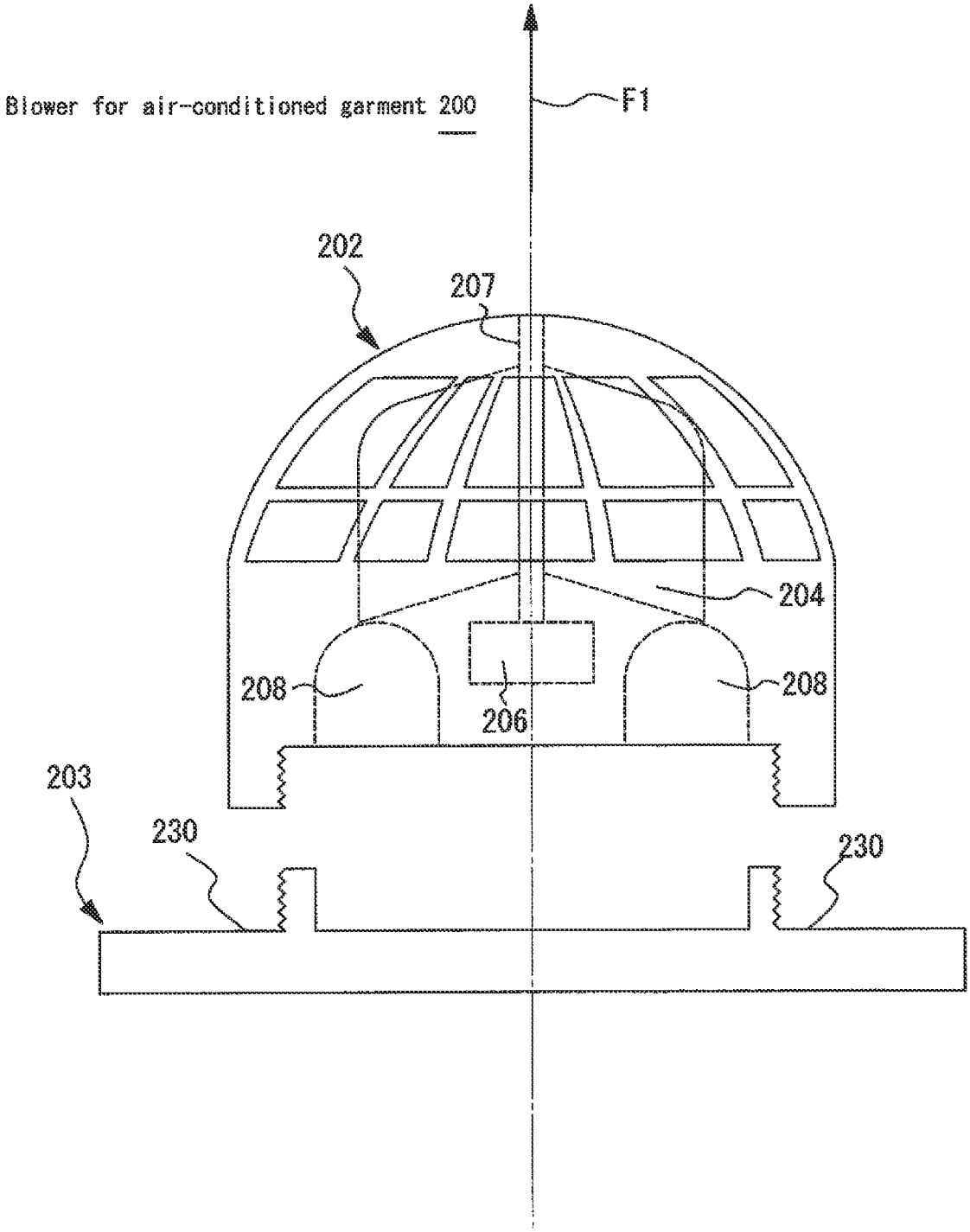
FIG. 22 is a cross-sectional view illustrating one example of the configuration of the blower for the air-conditioned garment in the fifth embodiment.

FIG. 22 illustrates one example of the blower 200 for the air-conditioned garment that is different from the configuration of the blower 200 for the air-conditioned garment described above. The main body part 202 has a dome shape in cross section and includes the fan 204, the motor 206, and the batteries 206. In the main body part 202, the front side with respect to the airflow direction F1 has a steeple shape.

The batteries 206 are disposed on the rear side with respect to the fan 204 with respect to the flow direction of the gas. Alternatively, the batteries 208 may be disposed on the outer side with respect to the outer diameter of the fan 204 from the rotation shaft 207 instead.

The rear frame 203 is configured to be engaged with the rear surface side of the main body part 202. When the rear frame 203 is engaged with the main body part 202, the rear frame 203 and the main body part 202 are engaged with each other across the mounting hole in the air-conditioned garment 100. The main body part 202 and the rear frame 203 are engaged with each other while sandwiching the cloth on the peripheral edge of the mounting hole therebetween. As a result, the blower 200 for the air-conditioned garment is installed on the air-conditioned garment 100.

Figure 23:
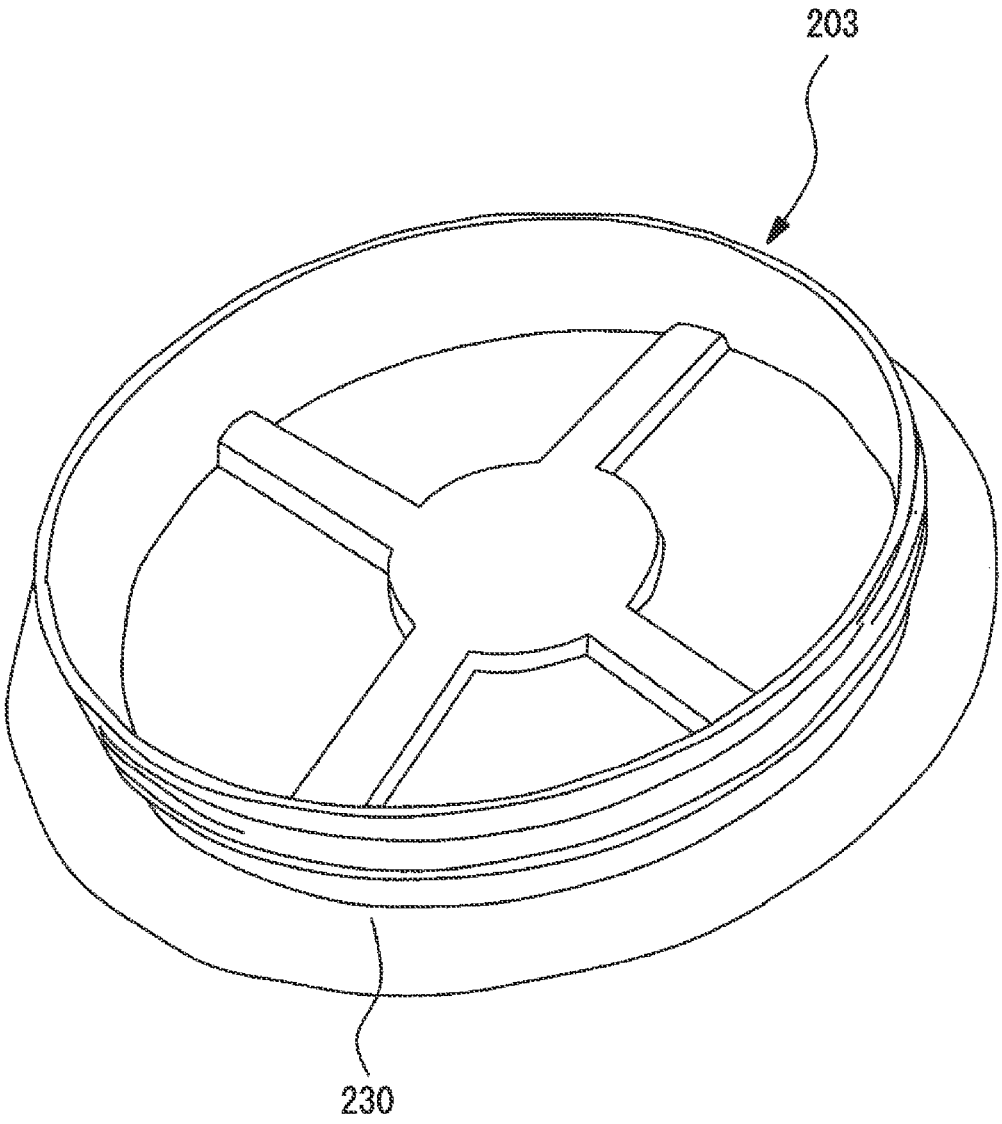
FIG. 23 illustrates one example of the configuration of the rear frame in the fifth embodiment.

FIG. 23 illustrates one example of the configuration of the rear frame 203. In the illustrated example, the rear frame 203 includes a thread part that is engaged with the main body part 202. The rear frame 203 includes a sandwiching part 230 for sandwiching a peripheral edge part of the mounting hole in the air-conditioned garment 100.

The sandwiching part 230 and a corresponding part of the main body part 202 sandwich the peripheral edge part of the mounting hole in the air-conditioned garment 100 therebetween when the main body part 202 and the rear frame 203 are engaged with each other.

The present invention includes the invention described below.

A fan unit accommodating housing including: a main body part housing including: the through hole 220 that can house a fan unit including: a fan; and a motor; and a housing part that can house the battery 208 on a periphery of the through hole 220; the fan cover 212 detachably engaged with the main body part housing; and the rear frame 203 engaged with the main body part housing in a separable manner. In the fan unit accommodating housing, the fan cover 212 further includes: the engaging part 212*a* that is engaged with an inner peripheral side surface of the through hole 220; and the exhaust port 230 formed on a front side with respect to a flow direction of gas so as to be continuous with the engaging part 212*a*, and an inner periphery of the exhaust port 210 expands from an inner peripheral wall of the engaging part 212*a* to an outer side.

In the abovementioned fan unit accommodating housing, a length from the rotation shaft 207 to the inner peripheral wall of the engaging part 212*a* may be longer than an outer diameter of the fan 204 when the engaging part 212*a* is engaged with the inner peripheral side surface of the through hole 220.

In the above-mentioned fan unit accommodating housing, the rear frame 203 may further include the suction port 221 that sucks in gas, and the suction port 221 may have an inner diameter that gradually expands toward the rear side with respect to the flow direction of the gas.

In the above-mentioned fan unit accommodating housing, the through hole 220 may further include the first receiving part 224*a* that is engaged with the engaging part 212*a* of the fan cover 212 on an inner peripheral wall, and the first receiving part 224*a* may be formed so as to expand to the outer side with respect to a part of the inner peripheral wall other than the first receiving part 224*a*.

The invention claimed is:

1. A blower for an air-conditioned garment, the blower comprising:

a main body part including:

a fan; and a motor that drives the fan; and a rear frame that is engaged with the main body part, the blower being installable on the air-conditioned garment by separable engagement of the main body part and the rear frame, wherein:

the main body part includes:

a power supply unit that supplies power to the motor;

a control unit that controls driving of the motor; and an operation input unit that inputs a signal to the control unit in accordance with operation of a user;

the power supply unit being formed such that a distance between the power supply unit and a rotation shaft of the fan in a direction orthogonally intersecting the rotation shaft of the fan is longer than an outer diameter of the fan, the power supply unit being adjacent to an outer periphery of the fan at a longitudinal side of the power supply unit, wherein the power supply unit comprises a plurality of power supply units, the power supply units being unevenly distributed on a lower side adjacent the outer periphery of the fan; and the main body part and the rear frame are formed so as to sandwich the air-conditioned garment between the main body part and the rear frame.

2. The blower for the air-conditioned garment according to claim 1, wherein:

the rear frame includes a suction port that sucks in gas; and the suction port has an inner diameter that gradually expands toward a rear side in a flow direction of the gas.

3. The blower for the air-conditioned garment according to claim 1, wherein the main body part further includes:

a through hole that houses the fan in a rotation shaft direction of the fan; and a fan cover that detachably occludes the through hole on a front side with respect to the fan in a flow direction of gas.

4. The blower for the air-conditioned garment according to claim 3, wherein:

the fan cover includes an engaging part that is engaged with an inner peripheral side surface of the through hole; and a length from the rotation shaft to an inner peripheral wall of the engaging part is longer than the outer diameter of the fan when the fan cover is engaged with the inner peripheral side surface.

5. The blower for the air-conditioned garment according to claim 4, wherein:

the fan cover further includes an exhaust port formed on the front side in the flow direction of the gas so as to be continuous with the engaging part; and the exhaust port has an inner periphery that expands to an outer side from the inner peripheral wall of the engaging part.

6. The blower for the air-conditioned garment according to claim 1, wherein the power supply unit comprises a fixed power supply unit.

7. The blower for the air-conditioned garment according to claim 1, wherein the power supply unit comprises a removable power supply unit.

8. The blower for the air-conditioned garment according to claim 1, the plurality of power supply units being formed such that the distance between each of the plurality of power supply units and the rotation shaft of the fan in the direction orthogonally intersecting the rotation shaft of the fan is longer than the outer diameter of the fan, the plurality of power supply units being adjacent to the outer periphery of the fan at the longitudinal side, the plurality of power supply units being unevenly distributed on the lower side adjacent the outer periphery of the fan.

* * * * *